US011402101B2

(12) United States Patent
Cadima et al.

(10) Patent No.: US 11,402,101 B2
(45) Date of Patent: Aug. 2, 2022

(54) COOKTOP APPLIANCE WITH A GAS BURNER ASSEMBLY HAVING A THERMAL BREAK

(71) Applicant: Haier US Appliance Solutions, Inc., Wilmington, DE (US)

(72) Inventors: Paul Bryan Cadima, Crestwood, KY (US); John Pottenger, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 73 days.

(21) Appl. No.: 16/993,951

(22) Filed: Aug. 14, 2020

(65) Prior Publication Data

US 2022/0049850 A1 Feb. 17, 2022

(51) Int. Cl.

| | |
|---|---|
| ***F24C 3/08*** | (2006.01) |
| ***F24C 15/34*** | (2006.01) |
| ***F23D 14/62*** | (2006.01) |
| ***F23D 14/06*** | (2006.01) |

(52) U.S. Cl.

CPC ..... *F24C 3/085* (2013.01); *F23D 14/06* (2013.01); *F23D 14/62* (2013.01); *F24C 15/34* (2013.01)

(58) Field of Classification Search

CPC ..... F24C 3/085; F24C 15/34; F23D 14/06; F23D 14/62

USPC ..... 126/39 E, 39 H, 39 N

See application file for complete search history.

(56) References Cited

U.S. PATENT DOCUMENTS

| | | | | |
|---|---|---|---|---|
| 5,408,984 | A | 4/1995 | Maughan | |
| 9,151,494 | B2 | 10/2015 | Gianluca | |
| 10,415,824 | B2 | 9/2019 | Cadima | |
| 2019/0145626 | A1* | 5/2019 | Cadima | F23D 14/06 126/39 E |

FOREIGN PATENT DOCUMENTS

| | | | |
|---|---|---|---|
| CN | 105987383 | A | 10/2016 |
| CN | 110410785 | A | 11/2019 |
| EP | 1406043 | A1 | 4/2004 |
| JP | H083841 | Y2 | 1/1996 |
| JP | 2016200375 | A | 12/2016 |
| JP | 2019219157 | A | 12/2019 |

* cited by examiner

*Primary Examiner* — Vivek K Shirsat
(74) *Attorney, Agent, or Firm* — Dority & Manning, P.A.

(57) ABSTRACT

A cooktop appliance, as provided herein, may include a top panel and a gas burner assembly positioned at the top panel. The gas burner assembly may include an annular burner body, a fuel manifold, and a thermal break. The annular burner body may be positioned at the top panel at a top surface thereof. The annular burner body may define a central combustion zone, a plurality of flame ports at the central combustion zone, and a fuel chamber upstream from the plurality of flame ports. The annular burner body may be open at the central combustion zone such that a circumferentially bounded portion of the top panel is vertically exposed. The fuel manifold may be selectively connected to the annular burner body upstream from the fuel chamber. The thermal break may be formed along the circumferentially bounded portion of the top panel below the plurality of flame ports.

20 Claims, 22 Drawing Sheets

COOKTOP APPLIANCE WITH A GAS BURNER ASSEMBLY HAVING A THERMAL BREAK

FIELD OF THE INVENTION

The present subject matter relates generally to cooktop appliances with gas burner assemblies, such as gas range appliances or gas stove appliances.

BACKGROUND OF THE INVENTION

Certain cooktop appliances include gas burners for heating cooking utensils on the cooktop appliances. Gas burners that fire inwards, typically with a swirling flame pattern, offer better efficiency than traditional outward firing gas burners. However, known inward firing gas burners have various drawbacks.

One problem with known inward firing gas burners is that a center of the inward firing gas burners is open. A portion of the top panel below the open center is perforated to allow components of the inward firing gas burners to pass through the top panel, but spills can also pass through the perforated top panel. Such spills can be difficult to clean.

Other known inward firing gas burners have components, such as surfaces, passages and channels, at a center of the inward firing gas burner. Spills frequently collect on such components and are difficult to clean. The spills can also stain the components, particularly when the components are formed of porous cast metal, and stains are unsightly. Separate from or in addition to damage caused spills, the high heat generated by the burner can cause or exacerbate damage to the center surface(s). For instance, portions of a component (e.g., top panel, including surface coatings on the top panel) within the center may warp, crack, discolor, or craze over time. Moreover, directing secondary combustion air through the inward firing gas burners can also be difficult.

Accordingly, a cooktop appliance with features for limiting damage from heat or spills at, for instance, a top panel of the cooktop appliance would be useful. In particular, it would be advantageous to provide a cooktop appliance having features to manage or reduce heat at panel within a central portion of a burner.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a cooktop appliance is provided. The cooktop appliance may include a top panel and a gas burner assembly positioned at the top panel. The gas burner assembly may include an annular burner body, a fuel manifold, and a thermal break. The annular burner body may be positioned at the top panel at a top surface of the top panel. The annular burner body may define a central combustion zone, a plurality of flame ports at the central combustion zone, and a fuel chamber upstream from the plurality of flame ports to permit gaseous fuel flow into the central combustion zone through the plurality of flame ports. The annular burner body may be open at the central combustion zone such that a circumferentially bounded portion of the top panel is vertically exposed through the annular burner body at the central combustion zone. The fuel manifold may be selectively connected to the annular burner body upstream from the fuel chamber such that the gaseous fuel is flowable from the fuel manifold into the fuel chamber. The thermal break may be formed along the circumferentially bounded portion of the top panel below the plurality of flame ports.

In another exemplary aspect of the present disclosure, a cooktop appliance is provided. The cooktop appliance may include a top panel and a gas burner assembly positioned at the top panel. The gas burner assembly may include an annular burner body, a fuel manifold, and a thermal break. The annular burner body may be positioned at the top panel at a top surface of the top panel. The annular burner body may define a central combustion zone, a plurality of flame ports at the central combustion zone, and a fuel chamber upstream from the plurality of flame ports to permit gaseous fuel flow into the central combustion zone through the plurality of flame ports. The annular burner body may be open at the central combustion zone such that a circumferentially bounded portion of the top panel is vertically exposed through the annular burner body at the central combustion zone. The fuel manifold may be selectively connected to the annular burner body upstream from the fuel chamber such that the gaseous fuel is flowable from the fuel manifold into the fuel chamber. The fuel manifold may include a horizontal Venturi mixing tube disposed beneath the circumferentially bounded portion of the top panel. The thermal break may be formed along the circumferentially bounded portion of the top panel below the annular burner body and above the horizontal Venturi mixing tube.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
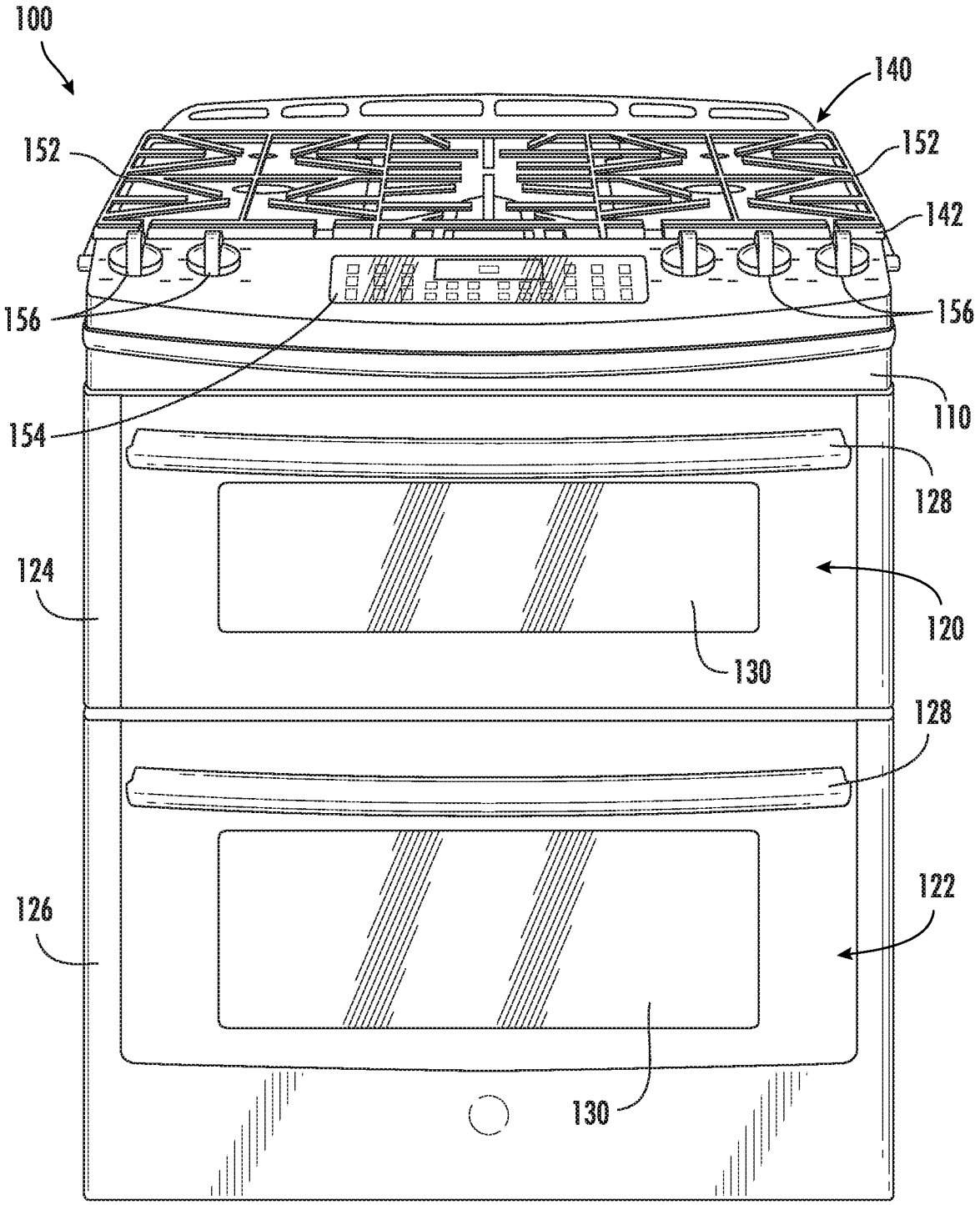
FIG. 1 provides a front, perspective view of a range appliance according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
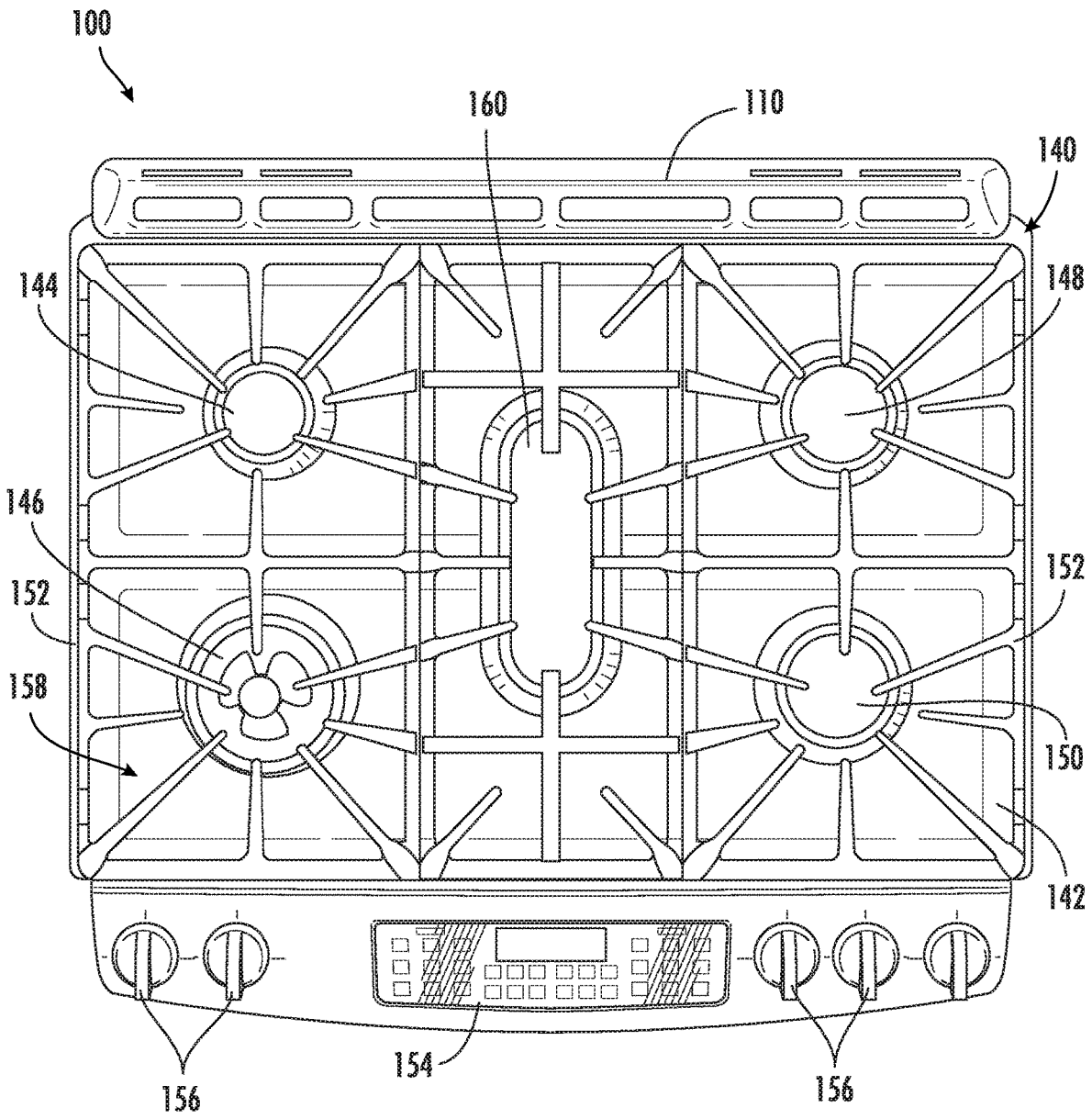
FIG. 2 provides a top, plan view of the exemplary range appliance of FIG. 1.
Figure 3:
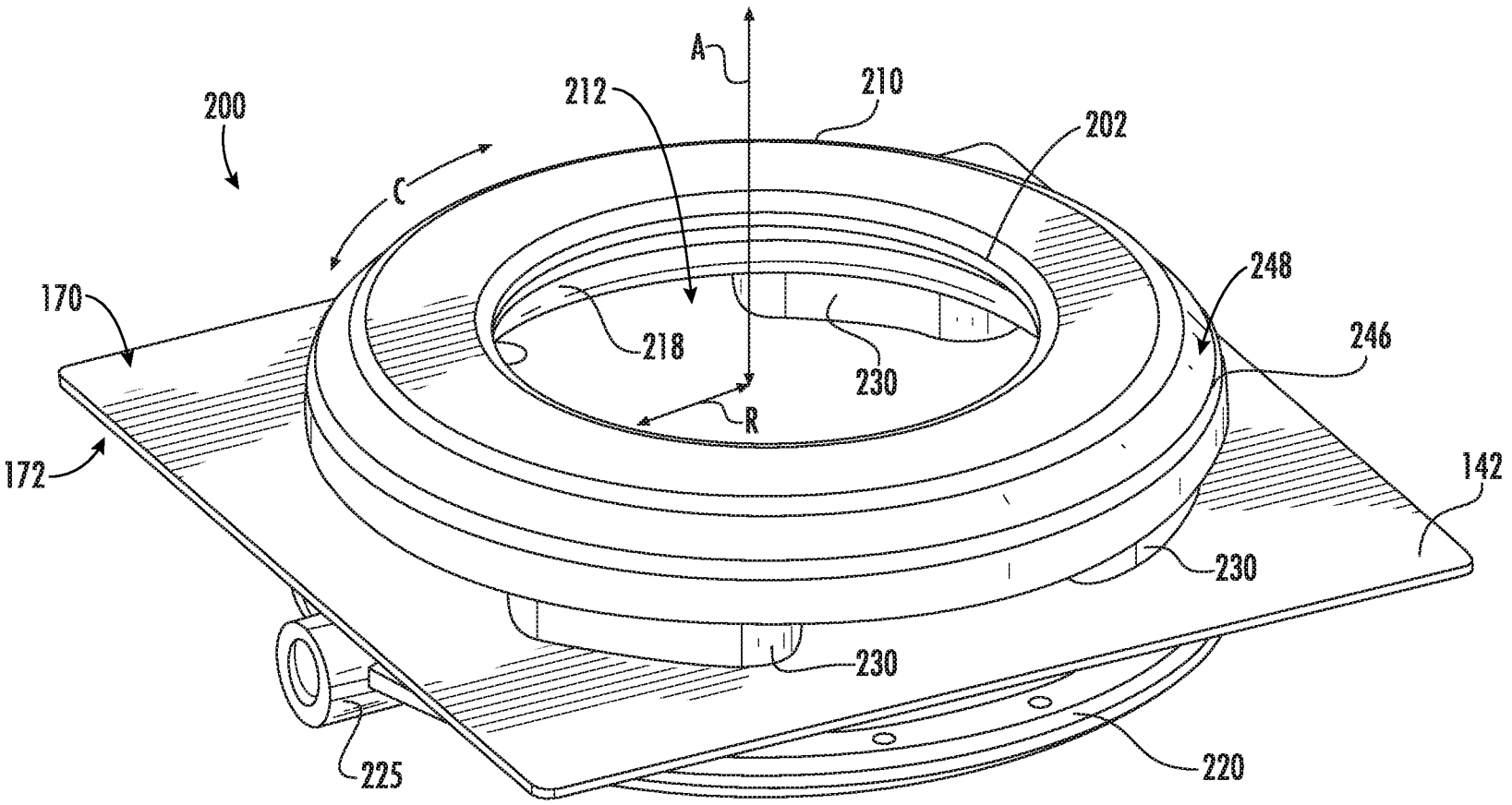
FIG. 3 provides a perspective view of a gas burner assembly according to exemplary embodiments of the present disclosure.
Figure 4:
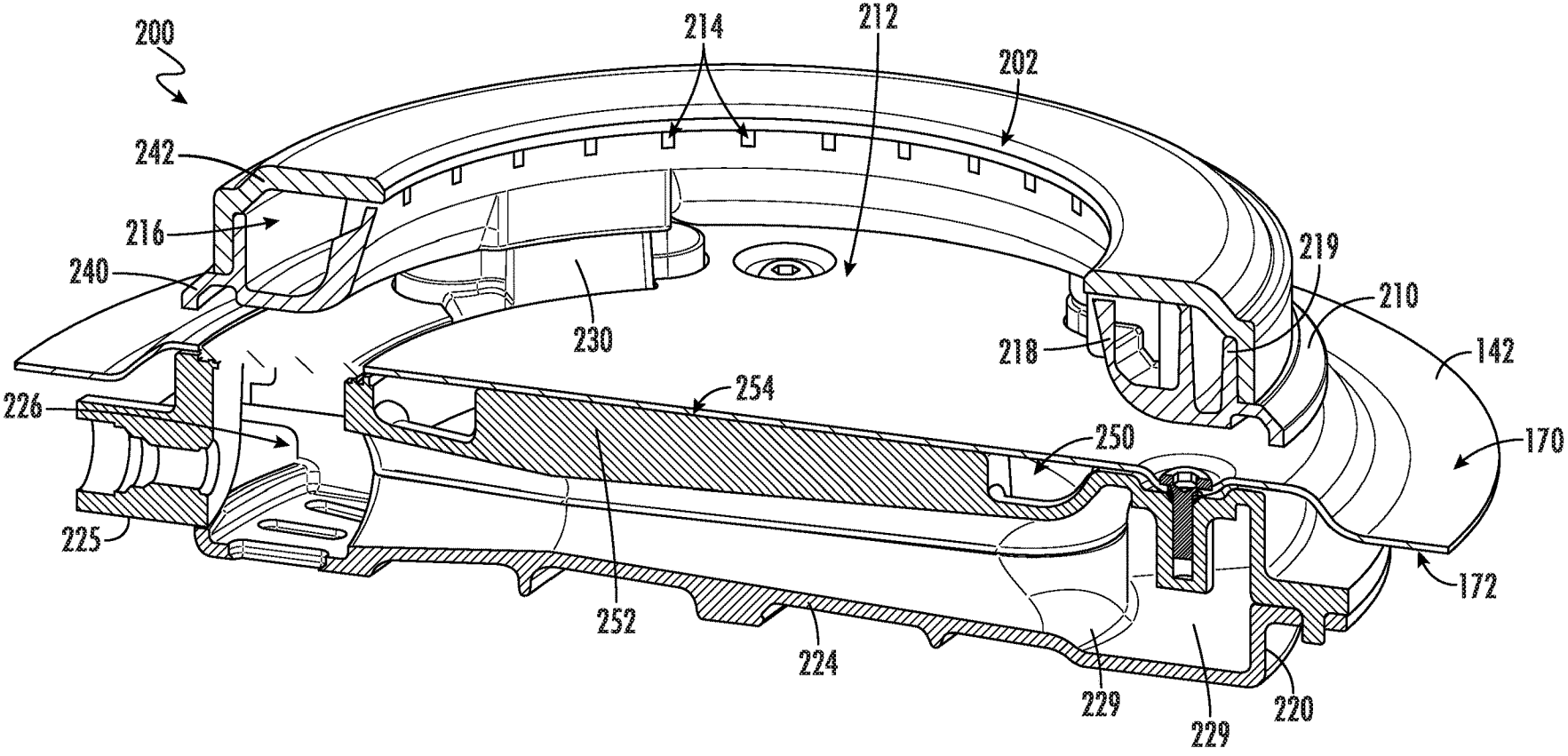
FIG. 4 provides a perspective cross-section view of an exemplary gas burner assembly embodiment of FIG. 3, wherein a burner cap has been removed.
Figure 5:
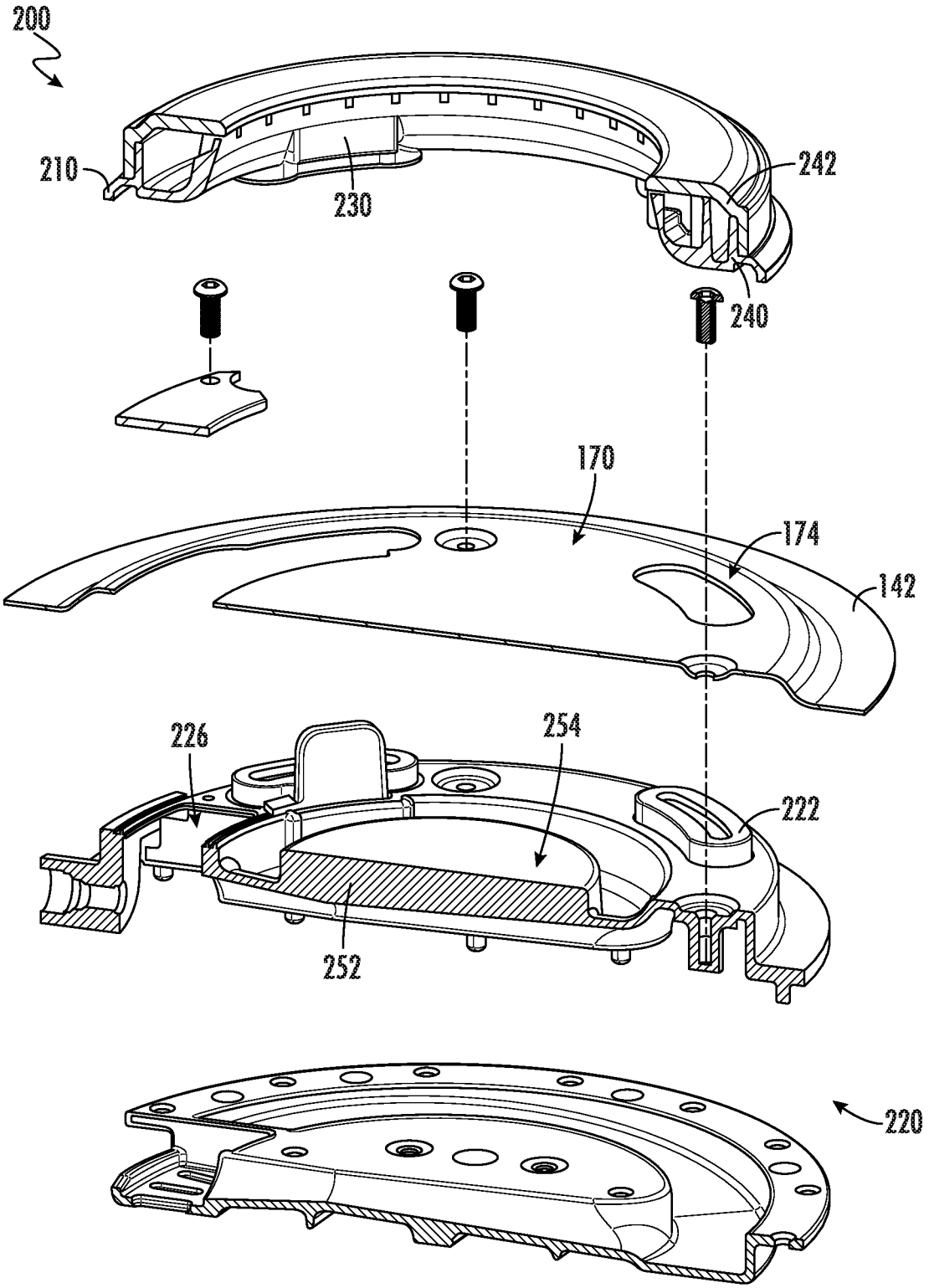
FIG. 5 provides an exploded cross-section view of the exemplary gas burner assembly embodiment of FIG. 4.
Figure 6:
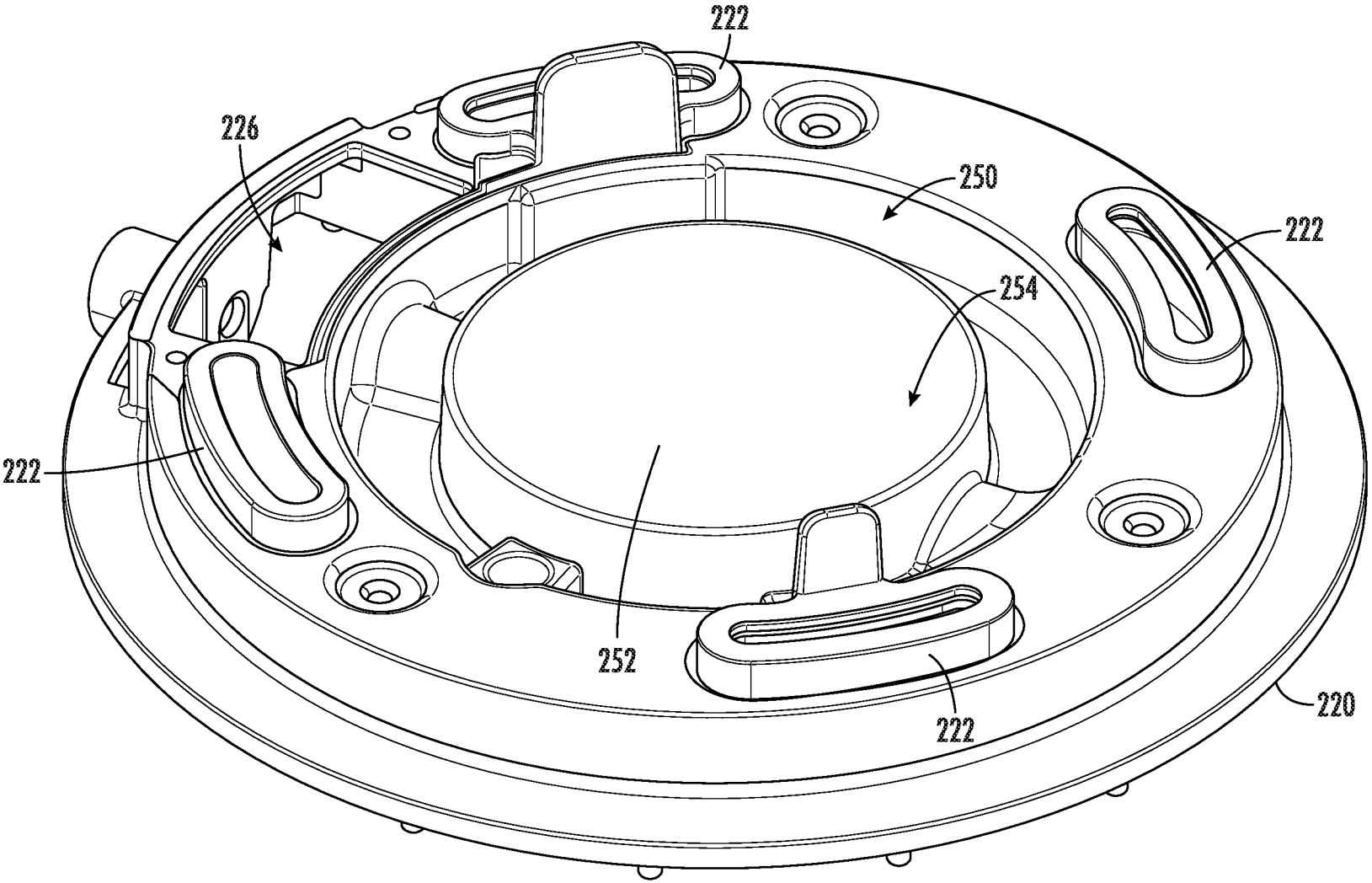
FIG. 6 provides a perspective view of a portion of the exemplary gas burner assembly embodiment of FIG. 4.
Figure 7:
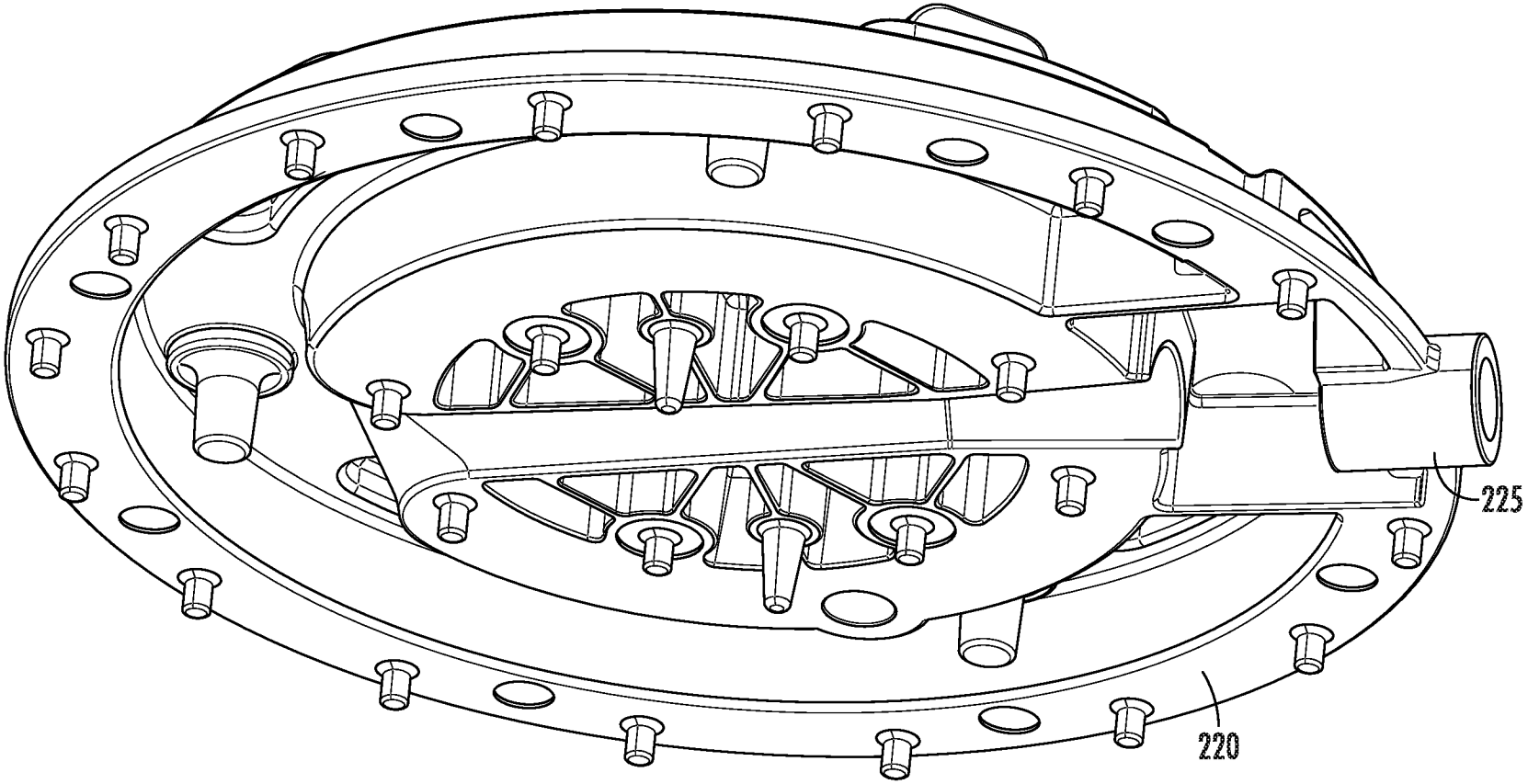
FIG. 7 provides a bottom perspective view of a portion of the exemplary gas burner assembly embodiment of FIG. 4.

Turning now to the figures, FIG. 1 provides a front, perspective view of a range appliance 100 as may be employed with the present disclosure. FIG. 2 provides a top, plan view of range appliance 100. Range appliance 100 includes an insulated cabinet 110. Cabinet 110 defines an upper cooking chamber 120 and a lower cooking chamber 122. Thus, range appliance 100 is generally referred to as a double oven range appliance. As will be understood by those skilled in the art, range appliance 100 is provided by way of example only, and the present disclosure may be used in any suitable appliance (e.g., a single oven range appliance or a standalone cooktop appliance). Thus, the exemplary embodiment shown in FIG. 1 is not intended to limit the present disclosure to any particular cooking chamber configuration or arrangement.

Upper and lower cooking chambers 120 and 122 are configured for the receipt of one or more food items to be cooked. Range appliance 100 includes an upper door 124 and a lower door 126 rotatably attached to cabinet 110 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass windowpanes 130 provide for viewing the contents of upper and lower cooking chambers 120 and 122 when doors 124 and 126 are closed and also assist with insulating upper and lower cooking chambers 120 and 122. Heating elements (not shown), such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

Range appliance 100 also includes a cooktop 140. Cooktop 140 is positioned at or adjacent a top portion of cabinet 110. Thus, cooktop 140 is positioned above upper and lower cooking chambers 120 and 122. Cooktop 140 includes a top panel 142. By way of example, top panel 142 may be constructed of glass, ceramics, enameled steel, and combinations thereof. Moreover, top panel 142 may be formed as a unitary, single piece or, alternatively, as multiple discrete pieces joined together.

For range appliance 100, a utensil holding food or cooking liquids (e.g., oil, water, etc.) may be placed onto grates 152 at a location of any of burner assemblies 144, 146, 148, 150. Burner assemblies 144, 146, 148, 150 provide thermal energy to cooking utensils on grates 152. As shown in FIG. 1, burners assemblies 144, 146, 148, 150 can be configured in various sizes so as to provide, for example, for the receipt of cooking utensils (e.g., pots, pans, etc.) of various sizes and configurations and to provide different heat inputs for such cooking utensils. Grates 152 may be supported on a top surface 158 of top panel 142. In optional embodiments, range appliance 100 includes a griddle burner 160 positioned at a middle portion of top panel 142, as may be seen in FIG. 2. A griddle may be positioned on grates 152 and heated with griddle burner 160.

A user interface panel 154 is located within convenient reach of a user of the range appliance 100. For this exemplary embodiment, user interface panel 154 includes knobs 156 that are each associated with one of burner assemblies 144, 146, 148, 150 and griddle burner 160. Knobs 156 allow the user to activate each burner assembly and determine the amount of heat input provided by each burner assembly 144, 146, 148, 150 and griddle burner 160 to a cooking utensil located thereon. User interface panel 154 may also be provided with one or more graphical display devices that deliver certain information to the user such as, for example, whether a particular burner assembly is activated or the rate at which the burner assembly is set.

Although shown with knobs 156, it should be understood that knobs 156 and the configuration of range appliance 100 shown in FIG. 1 is provided by way of example only. More specifically, user interface panel 154 may include various input components, such as one or more of a variety of touch-type controls, electrical, mechanical or electro-mechanical input devices including rotary dials, push buttons, and touch pads. The user interface panel 154 may include other display components, such as a digital or analog display device designed to provide operational feedback to a user.

Turning now to FIGS. 3 through 8, various views are provided of a gas burner assembly 200 according to an exemplary embodiment of the present disclosure. As an example, burner assembly 200 may be used in range appliance 100 (FIG. 2) as one of burner assemblies 144, 146, 148, 150. Nonetheless, it will be understood that, while describe in greater detail below in the context of range appliance 100, burner assembly 200 may be used in or with any suitable appliance in alternative exemplary embodiments.

Generally, burner assembly 200 includes an inner burner ring 202. Inner burner ring 202 may be inward firing with a swirling flame pattern. As discussed in greater detail below, burner assembly 200 includes features for managing or mitigating heat at top panel 142 (e.g., to prevent damage thereto). Burner assembly 200 defines an axial direction A, a radial direction R, and a circumferential direction C.

When assembled, burner assembly 200 is positioned at top panel 142. As noted above, top panel 142 may include multiple discrete elements or, alternatively, a single integral unitary piece (e.g., formed from sheet metal). Thus, burner assembly 200 may be positioned at a specific separable portion of top panel 142 (e.g., a mounting pan mounted to or supported on a support plate of top panel 142). Burner assembly 200 includes an annular burner body 210. Annular burner body 210 is positioned on top panel 142 at a top surface 170 of top panel 142. For example, annular burner body 210 may rest on top panel 142 at top surface 170 of top panel 142 such that annular burner body 210 is not fastened or otherwise mechanically fixed to top panel 142. Thus, a user may simply lift annular burner body 210 upwardly away from top panel 142 to remove annular burner body 210 from top panel 142.

Annular burner body 210 defines a central combustion zone 212. Annular burner body 210 also defines a plurality of flame ports 214 (e.g., at or facing central combustion zone 212). Flame ports 214 may be distributed, for example, along the circumferential direction C, about central combustion zone 212 upstream from a fuel chamber 216. Gaseous fuel is thus flowable from fuel chamber 216 within annular burner body 210 into central combustion zone 212 through flame ports 214. Flame ports 214 may also be oriented such that the gaseous fuel flows in a swirling pattern from flame ports 214 into central combustion zone 212. In certain embodiments, annular burner body 210 includes an inner side wall 218 and an outer side wall 219. Inner side wall 218 may extend around central combustion zone 212 (e.g., along the circumferential direction C). Flame ports 214 may be formed on or extend through inner side wall 218 (e.g., along the radial direction R, between fuel chamber 216 and central combustion zone 212). Outer side wall 219 may extend around inner side wall 218 (e.g., along the circumferential direction C). Outer side wall 219 may also be spaced from inner side wall 218 (e.g., along the radial direction R). Fuel chamber 216 may be defined and positioned between inner and outer side walls 218, 219 (e.g., along the radial direction R, within annular burner body 210).

Annular burner body 210 is open at central combustion zone 212. For example, no portion or component of annular burner body 210 may extend (e.g., inward or otherwise along the radial direction R) into central combustion zone 212. Top panel 142 may be exposed through annular burner body 210 at central combustion zone 212. Specifically, a circumferentially bounded portion of top panel 142 (e.g., bounded by annular burner body 210) may be exposed along the vertical direction. In such a manner, spills from utensils above burner assembly 200 may flow through central combustion zone 212 to top panel 142, and such spills may pass through burner assembly 200 without contacting burner assembly 200 at central combustion zone 212. Staining of annular burner body 210 may be reduced or limited by allowing spills to pass through annular burner body 210 at central combustion zone 212.

Top panel 142 may also be continuous or imperforate directly below central combustion zone 212. Thus, spills passing through central combustion zone 212 may collect on top panel 142 and not flow through top panel 142. A user may easily access and clean such spills on top panel 142 by removing annular burner body 210 from top panel 142. In such a manner, burner assembly 200 may facilitate cleaning of spills from utensils positioned over burner assembly 200.

Burner assembly 200 also includes a fuel manifold 220. Fuel manifold 220 is mounted to top panel 142 (e.g., with mechanical fasteners, such as bolts or screws, at a bottom surface 172 of top panel 142). Thus, fuel manifold 220 may be positioned opposite annular burner body 210 on or about top panel 142. Annular burner body 210 is connectable to fuel manifold 220 upstream from fuel chamber 216 such that the gaseous fuel is flowable from fuel manifold 220 into fuel chamber 216 of annular burner body 210. For example, fuel manifold 220 has a plurality of outlet passages 222. The gaseous fuel is flowable from fuel manifold 220 through outlet passages 222 into fuel chamber 216 of annular burner body 210.

As shown, fuel manifold 220 has a horizontal Venturi mixing tube 224. Horizontal Venturi mixing tube 224 has an inlet 226 and an outlet 228. Inlet 226 of horizontal Venturi mixing tube 224 may be positioned at one side portion of fuel manifold 220, and outlet 228 of horizontal Venturi mixing tube 224 may be positioned at an opposite side portion of fuel manifold 220. Thus, horizontal Venturi mixing tube 224 may extend across fuel manifold 220 (e.g., along the radial direction R) and inlet and outlet 226, 228 of horizontal Venturi mixing tube 224 may be positioned opposite each other on fuel manifold 220.

A fuel nozzle (not shown) may be positioned at and oriented towards inlet 226 of horizontal Venturi mixing tube 224. In particular, the fuel nozzle may be mounted to a fuel nozzle bracket 225 such that the fuel nozzle is spaced from inlet 226 of horizontal Venturi mixing tube 224 (e.g., along the radial direction R). The fuel nozzle may be connected to a supply line for gaseous fuel, such as propane or natural gas, and the gaseous fuel may flow from the fuel nozzle to inlet 226 of horizontal Venturi mixing tube 224. Between the fuel nozzle and inlet 226 of horizontal Venturi mixing tube 224, the gaseous fuel may entrain air, and the gaseous fuel may mix with the entrained air within horizontal Venturi mixing tube 224. The mixture of the gaseous fuel and air may exit horizontal Venturi mixing tube 224 at outlet 228 of horizontal Venturi mixing tube 224 and flow into an annular mixing chamber 229 within fuel manifold 220. Annular mixing chamber 229 is in fluid communication with outlet passages 222 such that the mixture of the gaseous fuel and air may flow from annular mixing chamber 229 into outlet passages 222. Thus, outlet passages 222 may extend upwardly (e.g., along the axial direction A) from annular mixing chamber 229.

Outlet passages 222 may be distributed or sized to facilitate uniform flow of the gaseous fuel from flame ports 214. For example, outlet passages 222 may be, for example, uniformly, distributed about central combustion zone 212. In addition, outlet passages 222 positioned proximate or closest to outlet 228 of horizontal Venturi mixing tube 224 may have a smaller outlet area (e.g., in a plane that is perpendicular to the axial direction A) than outlet passages 222 positioned proximate or closest to inlet 226 of horizontal Venturi mixing tube 224. Thus, the sizing of outlet passages 222 may be selected such that outlet passages 222 positioned proximate or closest to outlet 228 of horizontal Venturi mixing tube 224 are smaller than other outlet passages 222. Such relative sizing between outlet passages 222 may address velocity or pressure differences of the mixture of the gaseous fuel and air within annular mixing chamber 229.

In some embodiments, outlet passages 222 extend through top panel 142 (e.g., along the axial direction A) from fuel manifold 220 towards annular burner body 210. In particular, top panel 142 defines a plurality of openings 174. Each outlet passage 222 is received within and extends through a respective one of openings 174 of top panel 142. Thus, each opening 174 of top panel 142 is aligned with a respective outlet passage 222. Each opening 174 of top panel 142 may also be sized complementary with the respective outlet passage 222. Such sizing of openings 174 and outlet passages 222 may reduce leakage of spills through top panel 142.

Figure 8:
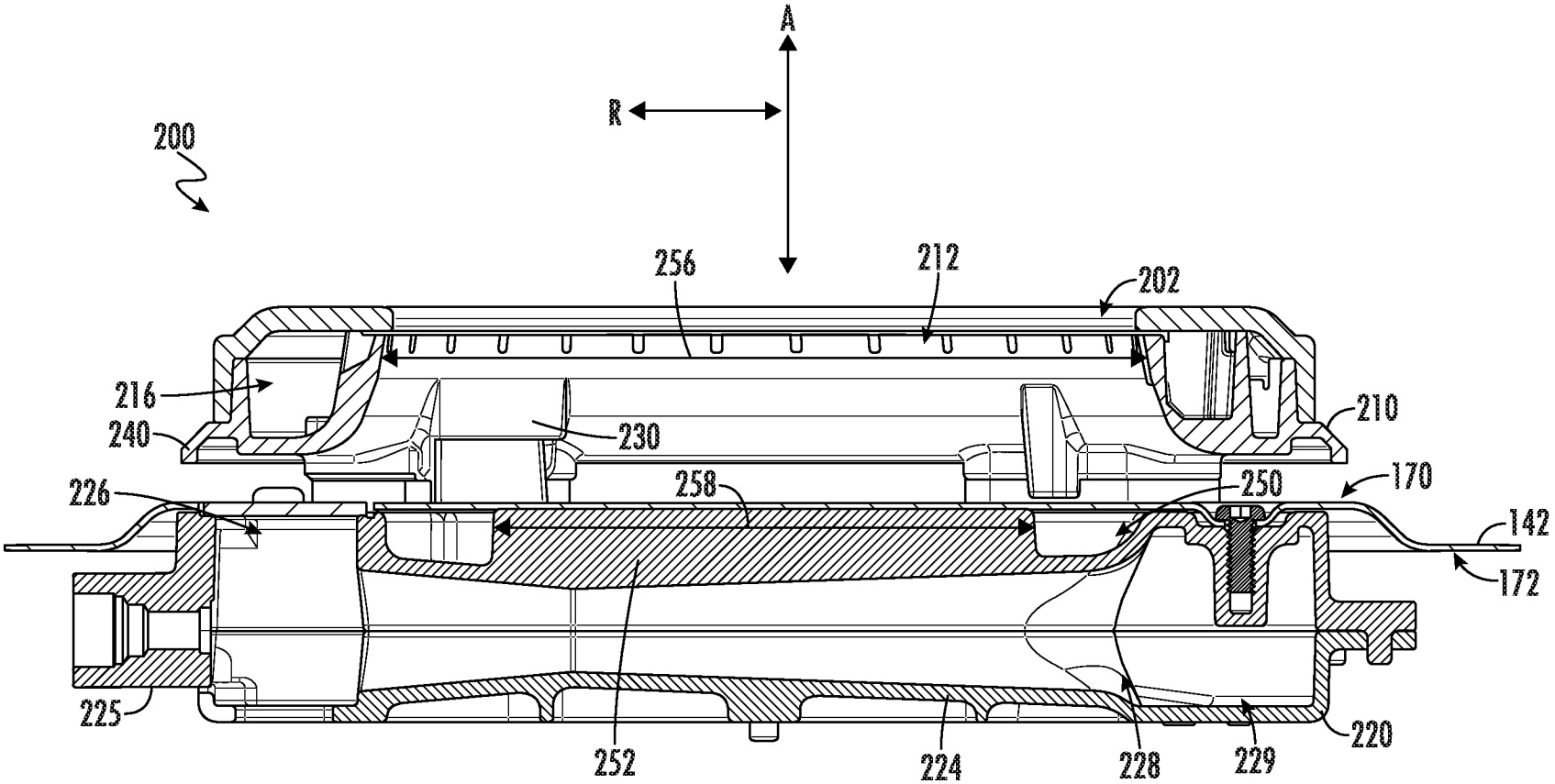
FIG. 8 provides an elevational cross-section view of the exemplary gas burner assembly embodiment of FIG. 4.

In certain embodiments, burner assembly 200 also includes a plurality of inlet passages 230. Inlet passages 230 extend downwardly (e.g., along the axial direction A) from annular burner body 210 towards top panel 142. As shown in FIG. 8, each inlet passage 230 may engage (e.g., be received on or over) a respective outlet passage 222. Thus, the gaseous fuel is flowable from outlet passages 222 of fuel manifold 220 into fuel chamber 216 of annular burner body 210 through inlet passages 230. Outlet passages 222 and inlet passages 230 may form flow paths for the gaseous fuel between fuel manifold 220 and annular burner body 210.

In additional or alternative embodiments, annular burner body 210 is suspended over top panel 142 on inlet passages 230. In particular, inlet passages 230 may extend (e.g., along the axial direction A) from annular burner body 210 to top panel 142 such that ends of inlet passages 230 rest on top panel 142 and annular burner body 210 is spaced from top panel 142 (e.g., along the axial direction A). With annular burner body 210 suspended over top panel 142, secondary combustion air is flowable under annular burner body 210 (e.g., along the radial direction R) into central combustion zone 212. The secondary combustion air can facilitate clean and efficient combustion of the gaseous fuel from flame ports 214 within central combustion zone 212.

As shown, annular burner body 210 may include an annular burner base 240 and an annular burner head 242. Annular burner base 240 includes inlet passages 230 and may be positioned on or over top panel 142. Annular burner head 242 may be positioned on annular burner base 240 to form fuel chamber 216 of annular burner body 210. Thus, annular burner base 240 may form a bottom wall of fuel chamber 216, and annular burner head 242 may form a top wall of fuel chamber 216. Annular burner base 240 or annular burner head 242 may be formed of or with bronze or a cast metal, such as cast iron or cast aluminum.

Optionally, annular burner body 210 may also include an annular burner cap 246. For instance, annular burner cap 246 may be positioned on annular burner head 242 such that annular burner cap 246 covers annular burner head 242. Annular burner cap 246 may reduce staining of annular burner base 240 or annular burner head 242. For example, annular burner cap 246 may include an enamel coating on an outer surface 248 of annular burner cap 246. For example, the enamel coating may face away from annular burner head 242 and be visible to a user of burner assembly 200 when burner assembly 200 is positioned on top panel 142. The enamel coating on annular burner cap 246 may be easier to clean than and less stainable by spills from cooking utensils than the cast metal of annular burner base 240 or annular burner head 242.

As shown, a thermal break 250 is provided in or below the combustion zone 212. Specifically, thermal break 250 may be provided at a portion of top panel 142, radially inward from annular burner body 210 to advantageously prevent damage or otherwise manage heat generated within combustion zone 212. For instance, thermal break 250 may be formed along the circumferentially bounded portion of the top panel 142 below the plurality of flame ports 214. Thus, heat absorbed at the portion of the top panel 142 vertically or axially aligned with the central combustion zone 212 may be advantageously reduced.

In some embodiments, thermal break 250 is further formed between the annular burner body 210 and above horizontal Venturi mixing tube 224. Thus, relative to a vertical direction (e.g., parallel to the axial direction A), thermal break 250 may be disposed below the annular burner body 210 and above horizontal Venturi mixing tube 224. In some such embodiments, thermal break 250 is directly above Venturi mixing tube and may, thus, have a footprint in the horizontal or radial plane that overlaps with horizontal Venturi mixing tube 224 (e.g., from above or below assembly 200). In additional or alternative embodiments, thermal break 250 is radially inward from annular burner body 210 and may, thus, be circumferentially bounded by annular burner body 210 while still being disposed lower than all (or at least a portion of) annular burner body 210.

As shown in FIGS. 4 through 8, thermal break 250 may include a conductive heat sink 252 formed from a thermally conductive metal material (e.g., aluminum or steel, including alloys thereof) below top panel 142. In some embodiments, conductive heat sink 252 extends (e.g., upward along the vertical or axial direction A) from fuel manifold 220 to a top face 254. Thus, the base or bottom of conductive heat sink 252 may be disposed on or formed at fuel manifold 220 while top face 254 defines the upper end of conductive heat sink 252. For instance, the base or bottom of conductive heat sink 252 may be formed on horizontal Venturi mixing tube 224. Optionally, conductive heat sink 252 may be formed as an integral unitary (e.g., monolithic) element with at least a portion of fuel manifold 220. Additionally or alternatively, top face 254 may be formed as a planar surface or surface having a shape that otherwise matches or complements the bottom surface 172. During use (e.g., cooking or burning operations of burner assembly 200), heat received at top face 254 may be conducted away from top panel 142 and through conductive heat sink 252 to fuel manifold 220 and the ambient air surrounding conductive heat sink 252.

In some embodiments, top face 254 is disposed beneath (e.g., in contact or conductive thermal communication with) a bottom surface 172 of top panel 142. Specifically, top face 254 may be disposed beneath the bottom surface 172 at the circumferentially bounded portion of the top panel 142. Thus, top face 254 spans at least a portion of the horizontal area defined by the central combustion zone 212 (e.g., in the radial plane). Moreover, the horizontal area of the central combustion zone 212 has a horizontal zone radius or width 256 (e.g., maximum width along the radial direction R). Similarly, top face 254 may define a horizontal area having a horizontal face radius or width 258 (e.g., maximum width along the radial direction R or parallel to the horizontal zone width 256). As shown, the horizontal area of the top face 254 may overlap the horizontal area of the central combustion zone 212 (e.g., in the radial plane viewed from above or below assembly 200). For instance, the horizontal area of the top face 254 may be axially aligned with the horizontal area of the central combustion zone 212 (e.g., such that the horizontal areas are coaxial with each other). In some such embodiments, the horizontal face width 258 may be greater than (e.g., define a measured distance) 40% of the horizontal zone width 256; such as greater than or equal to 50%, 75%, or 95%. In additional or alternative embodiments, the horizontal face width 258 may be less than or equal to the horizontal zone width 256.

Figure 9:
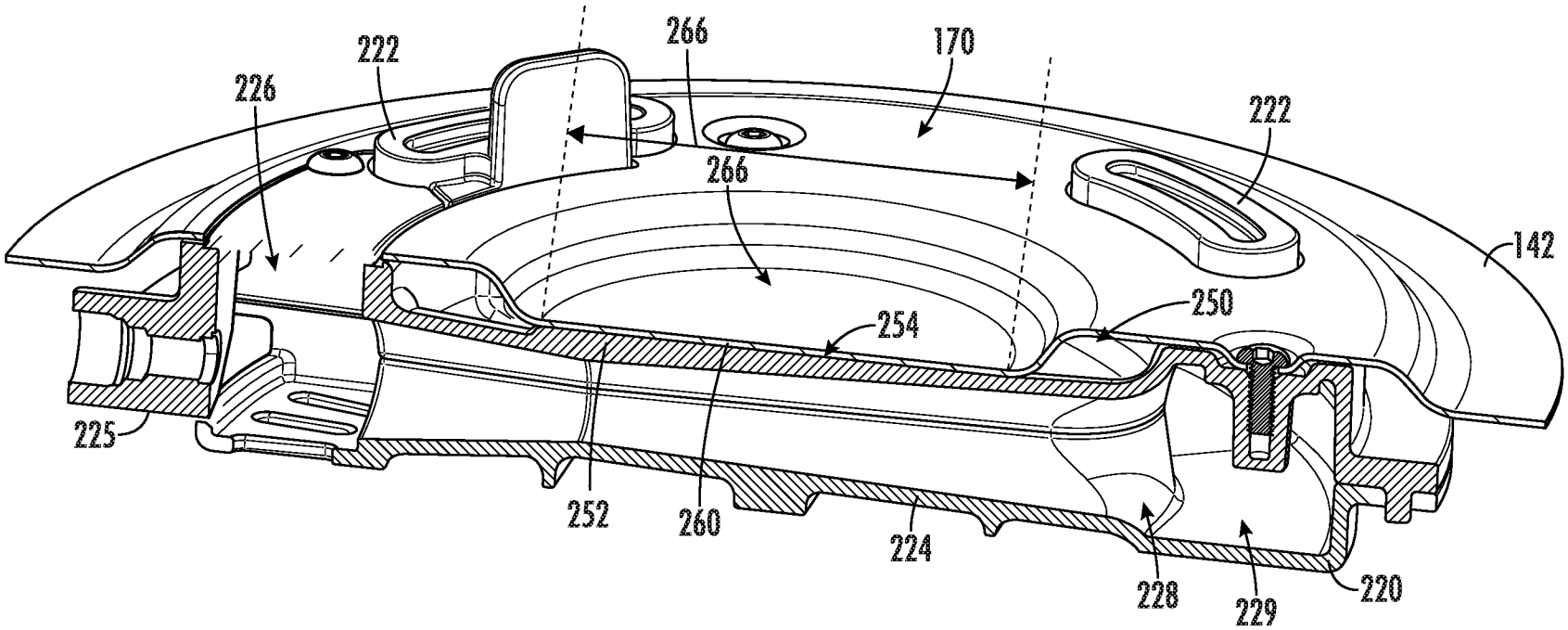
FIG. 9 provides a perspective cross-section view of a portion of a gas burner assembly according to exemplary embodiments of the present disclosure.
Figure 10:
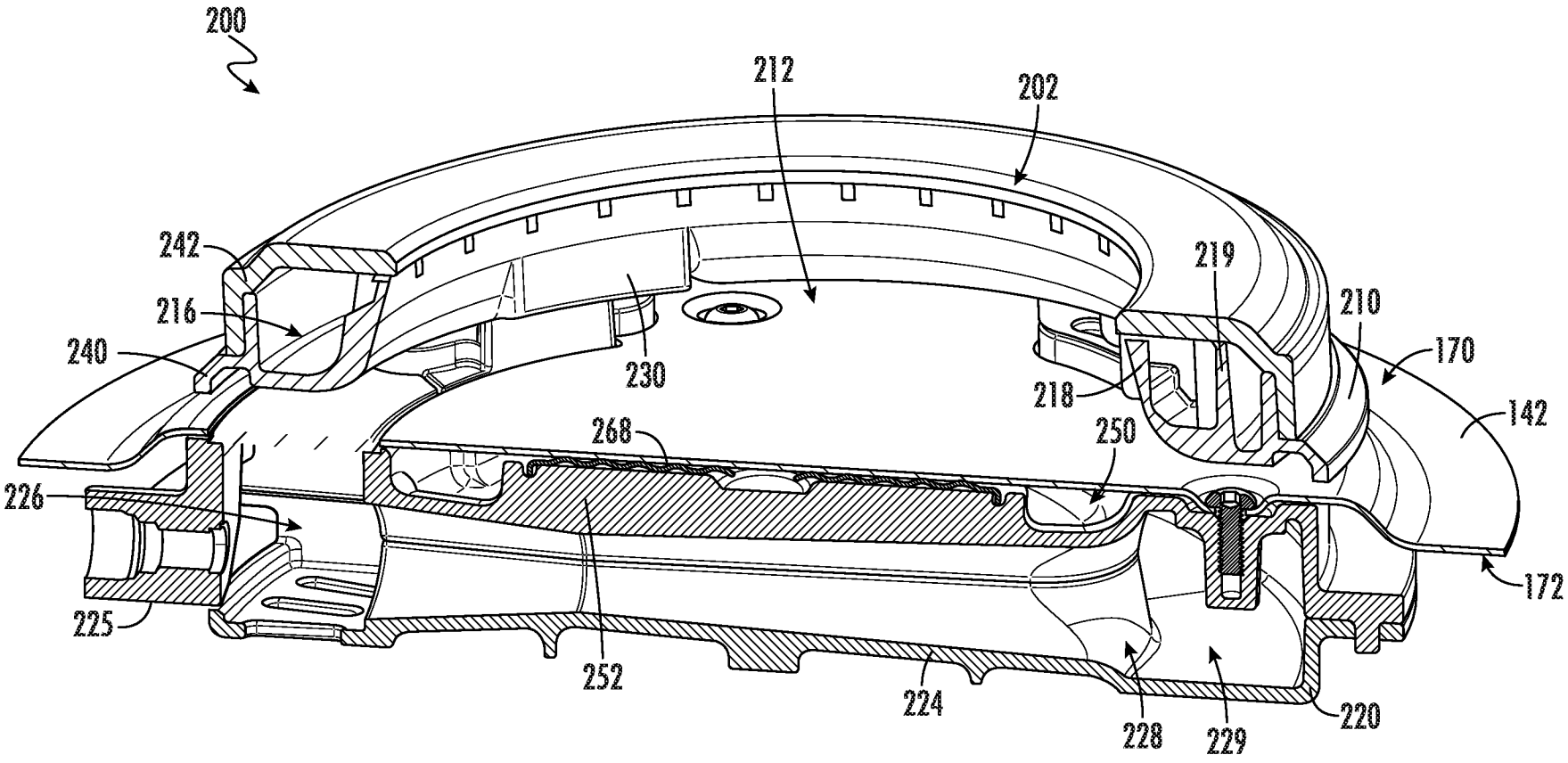
FIG. 10 provides a perspective cross-section view of an exemplary gas burner assembly embodiment of FIG. 3.
Figure 11:
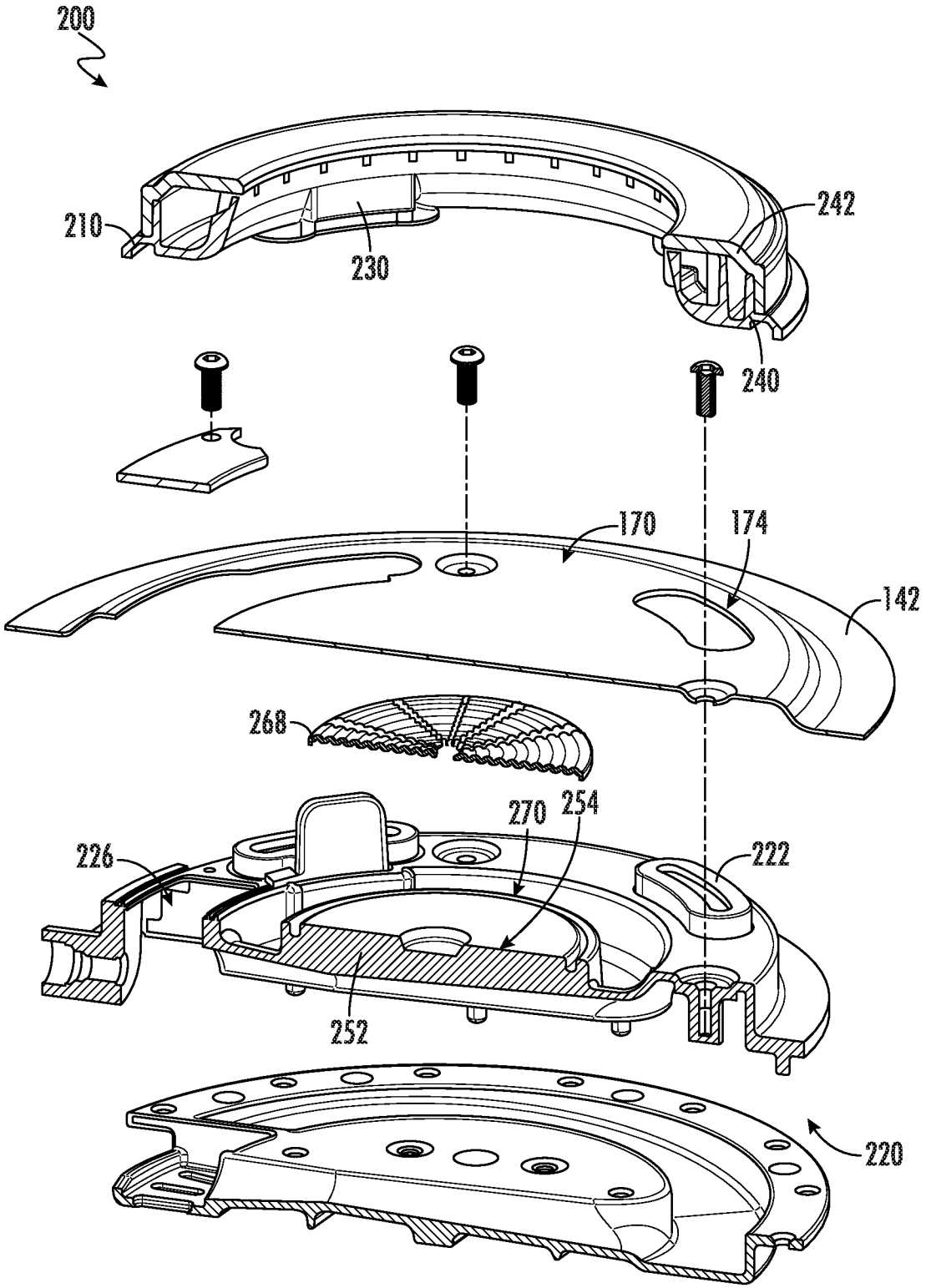
FIG. 11 provides an exploded cross-section view of the exemplary gas burner assembly embodiment of FIG. 10.
Figure 12:
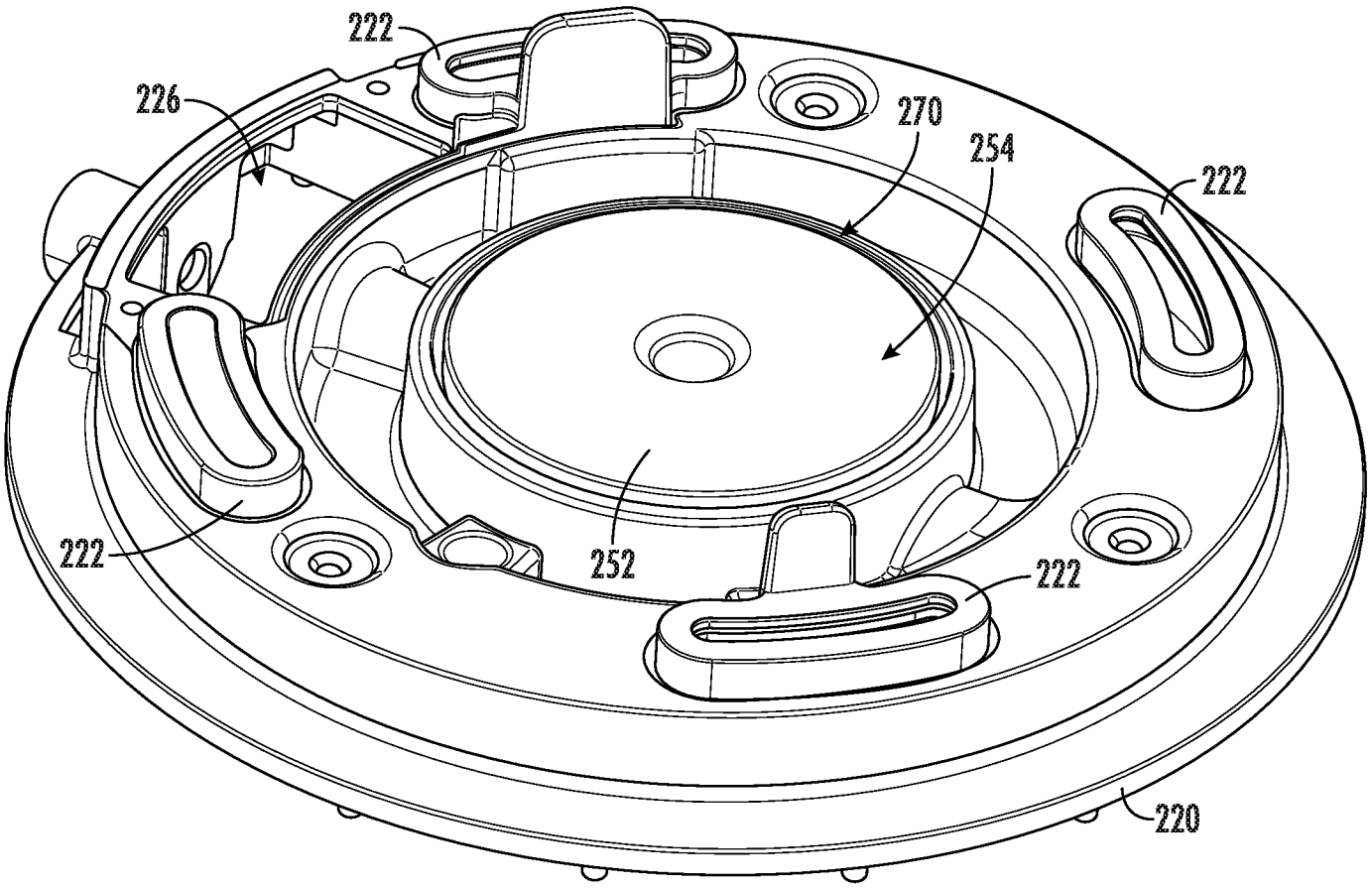
FIG. 12 provides a perspective view of a portion of the exemplary gas burner assembly embodiment of FIG. 10.
Figure 13:
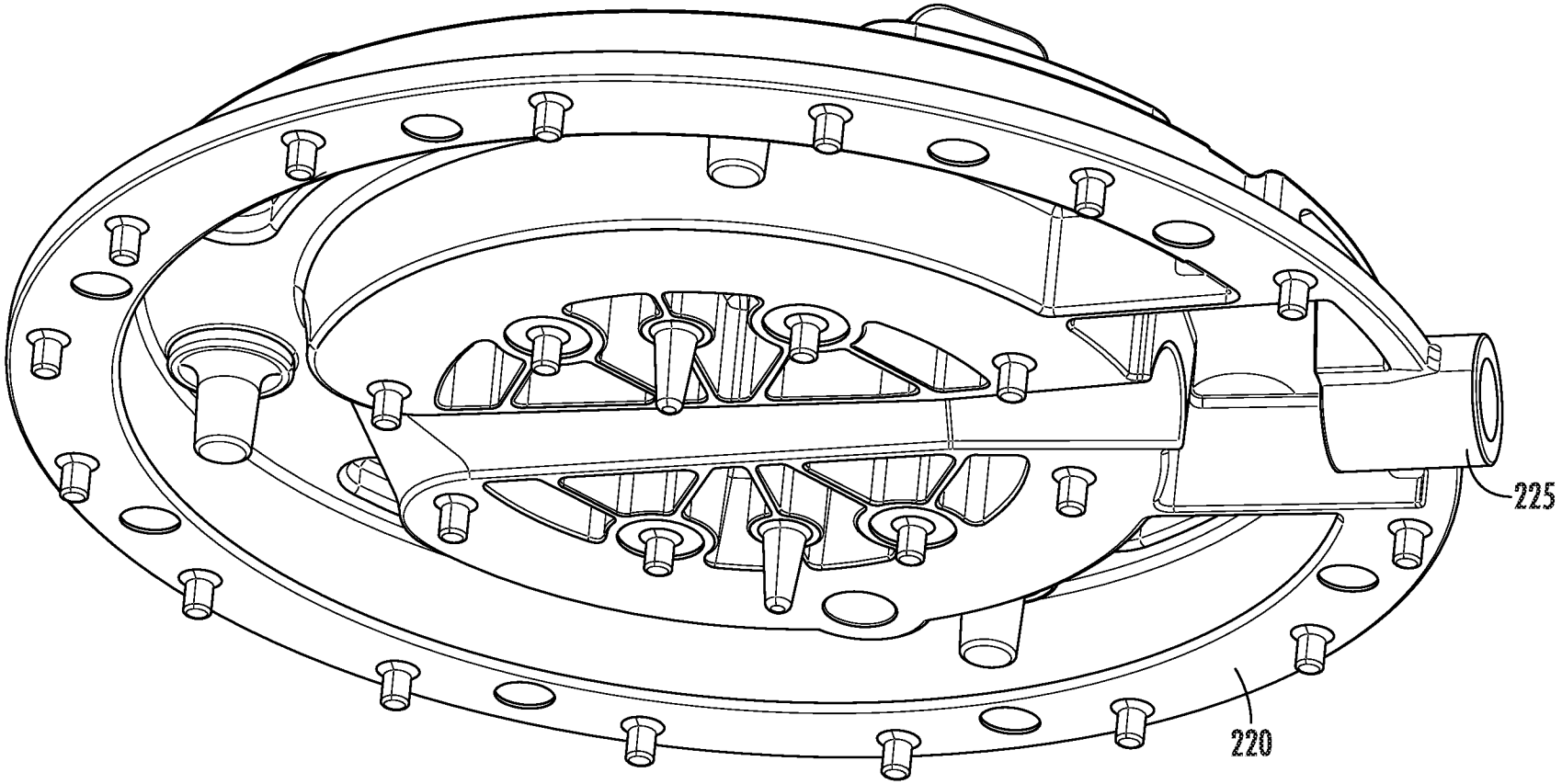
FIG. 13 provides a bottom perspective view of a portion of the exemplary gas burner assembly embodiment of FIG. 10.
Figure 14:
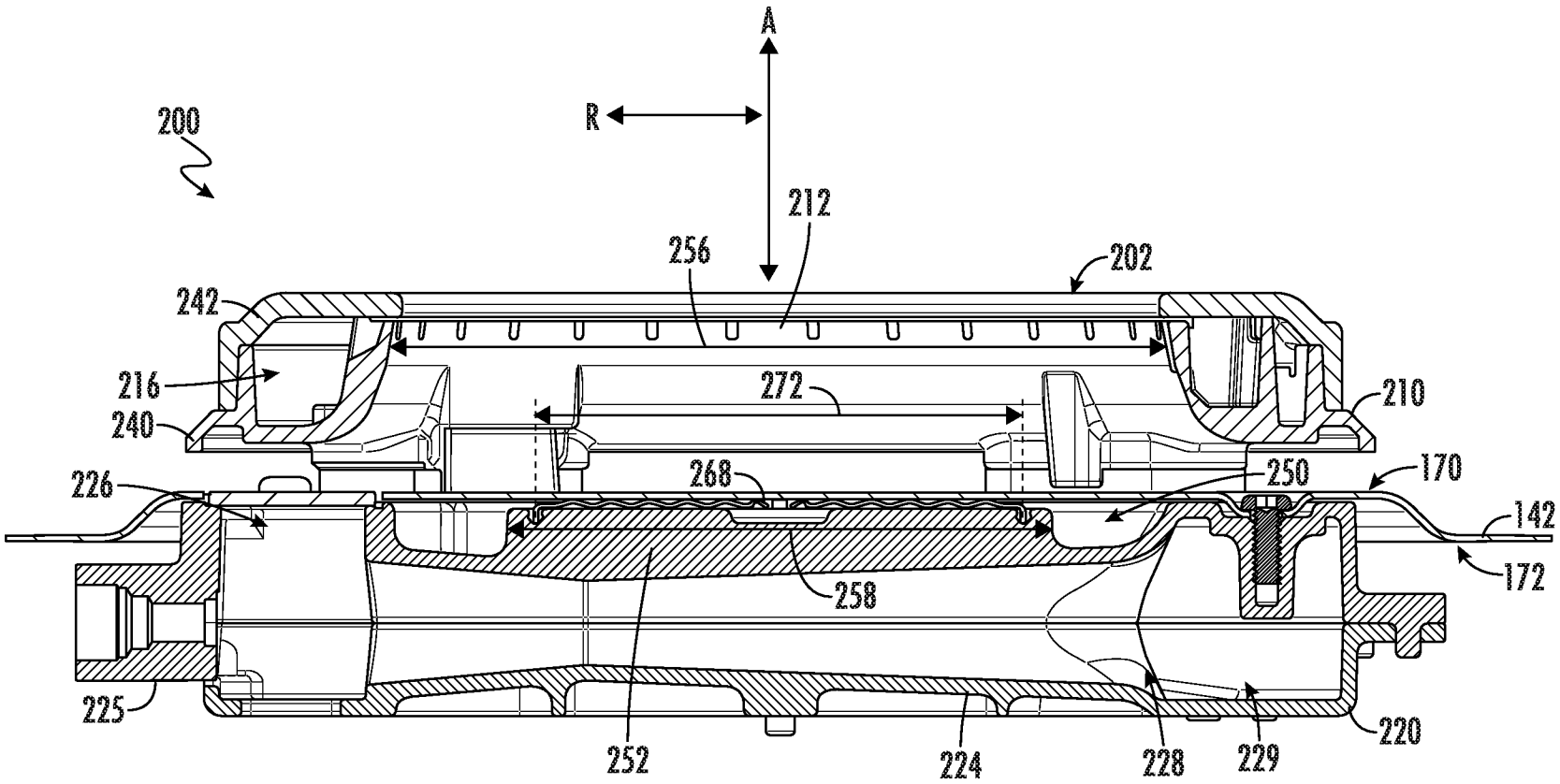
FIG. 14 provides an elevational cross-section view of the exemplary gas burner assembly embodiment of FIG. 10.
Figure 15:
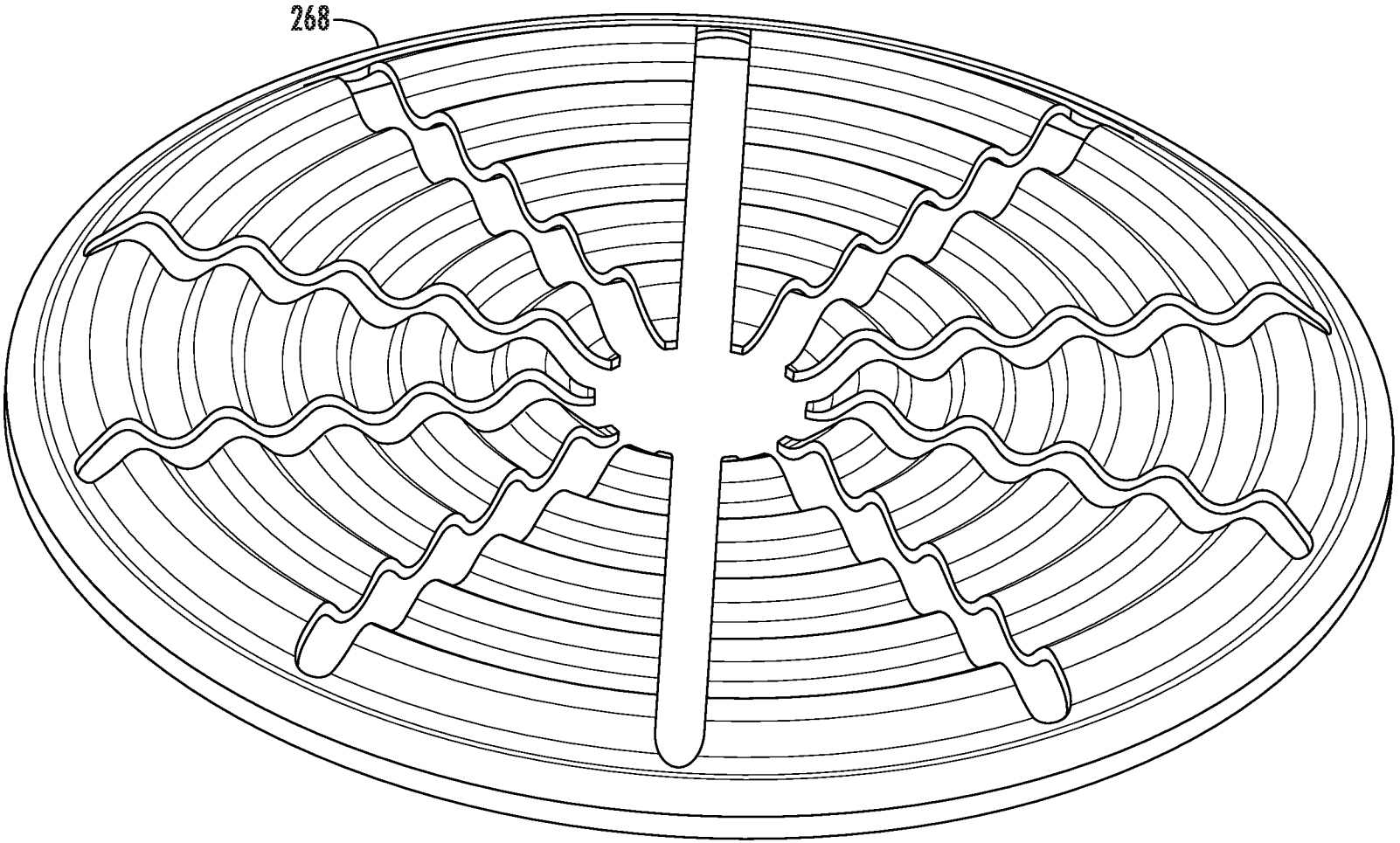
FIG. 15 provides a perspective view of a deformable contact plate of the exemplary gas burner assembly embodiment of FIG. 10.
Figure 16:
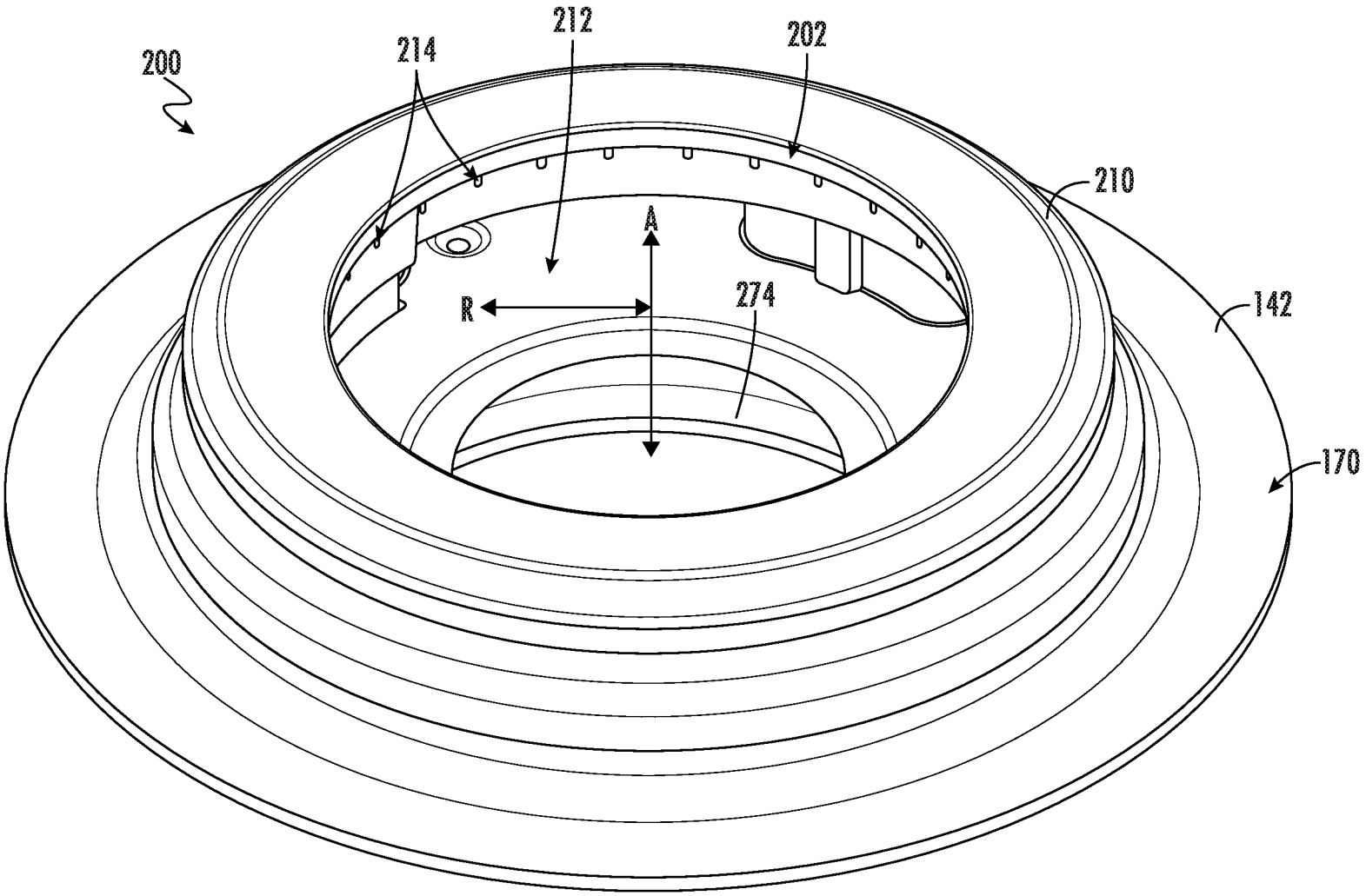
FIG. 16 provides a perspective view of a gas burner assembly according to exemplary embodiments of the present disclosure.
Figure 17:
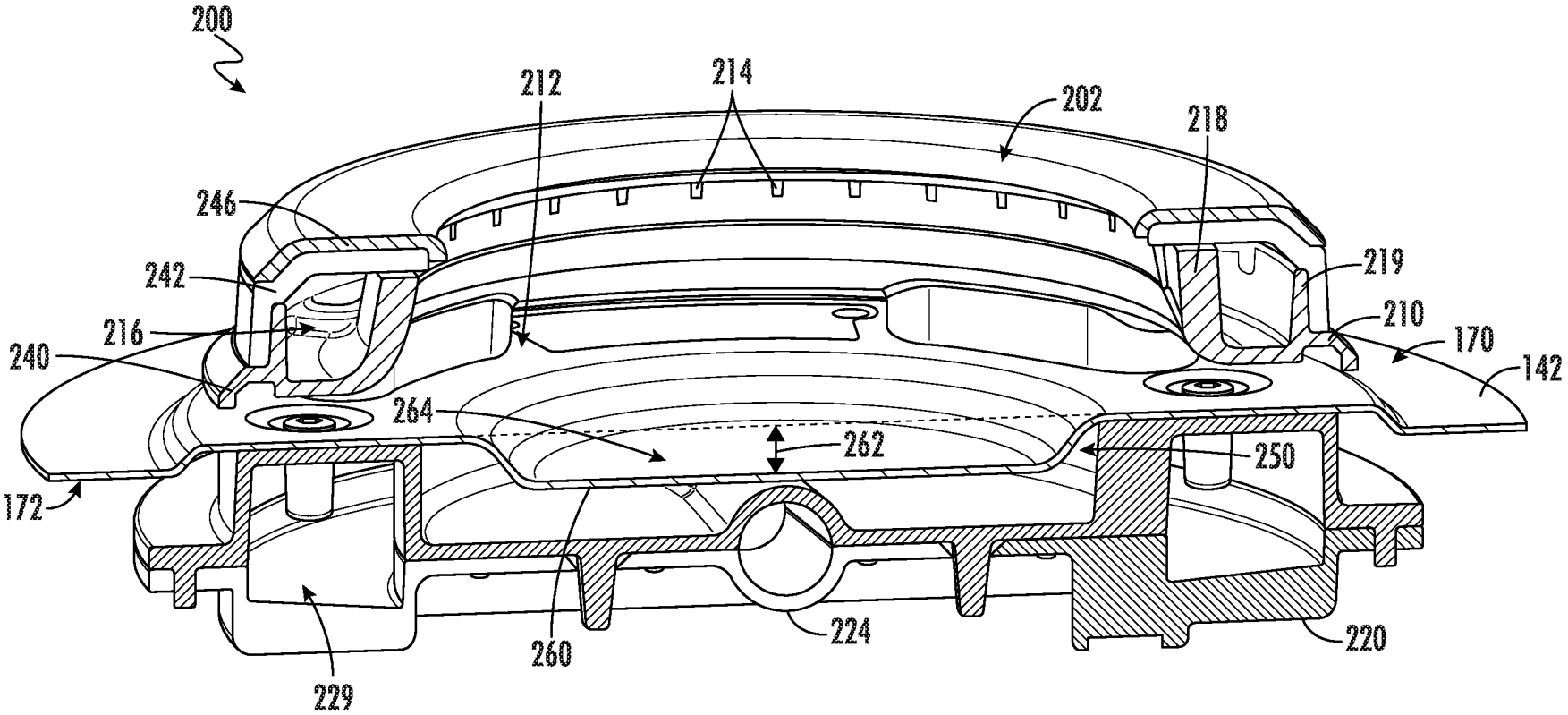
FIG. 17 provides a perspective cross-section view of an exemplary gas burner assembly embodiment of FIG. 16.
Figure 18:
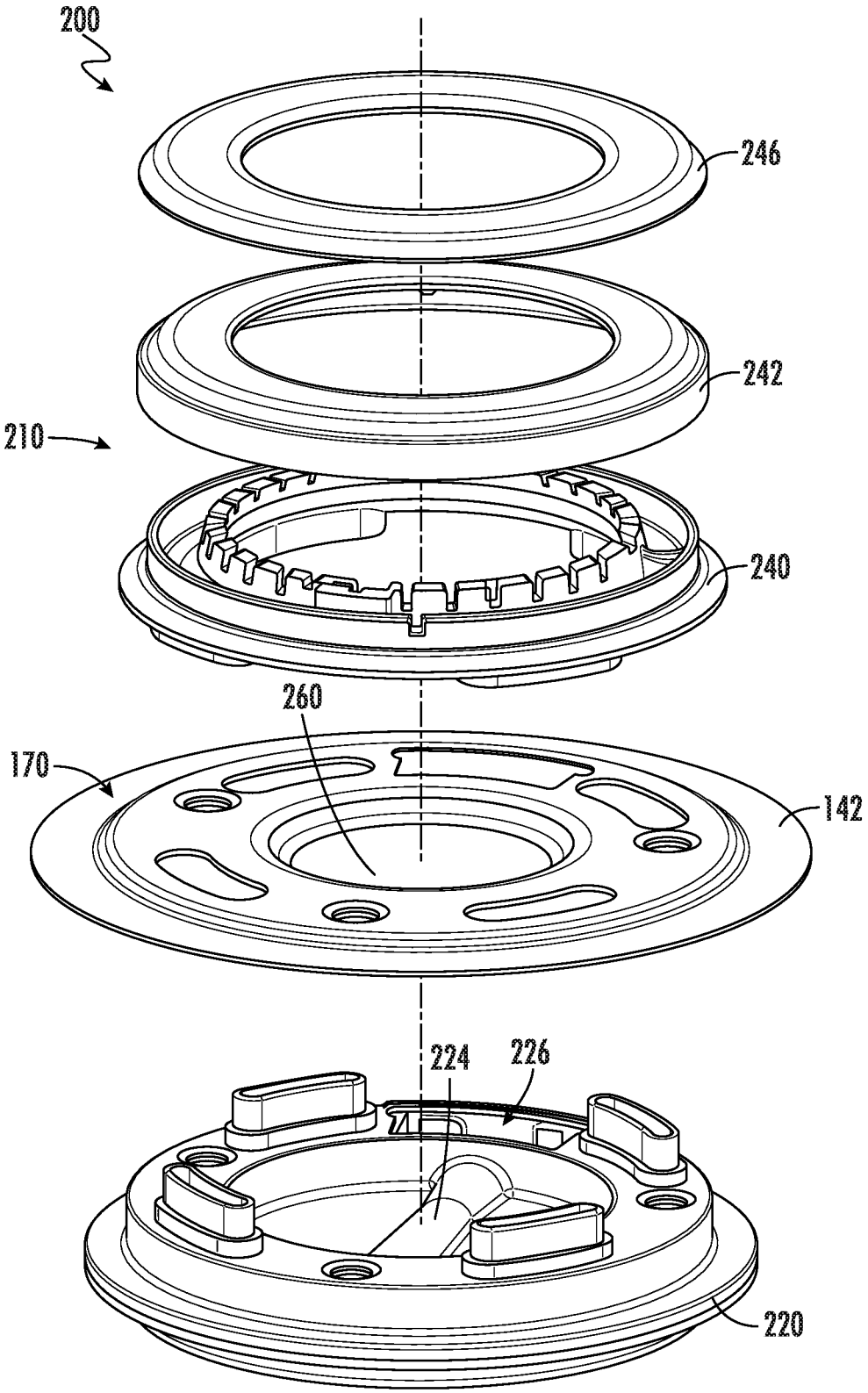
FIG. 18 provides an exploded perspective view of the exemplary gas burner assembly embodiment of FIG. 17.
Figure 19:
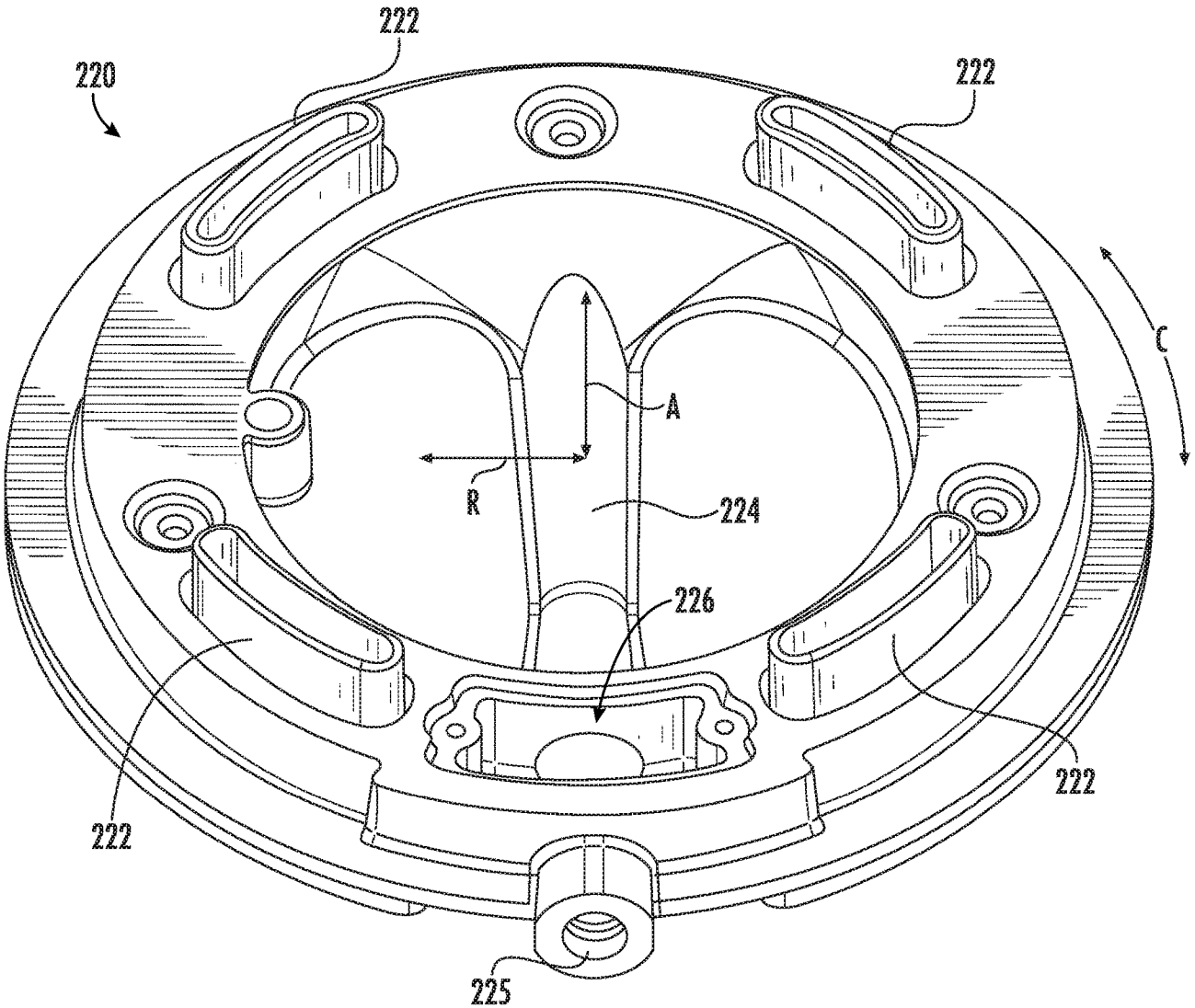
FIG. 19 provides a perspective view of a fuel manifold of the exemplary gas burner assembly embodiment of FIG. 17.
Figure 20:
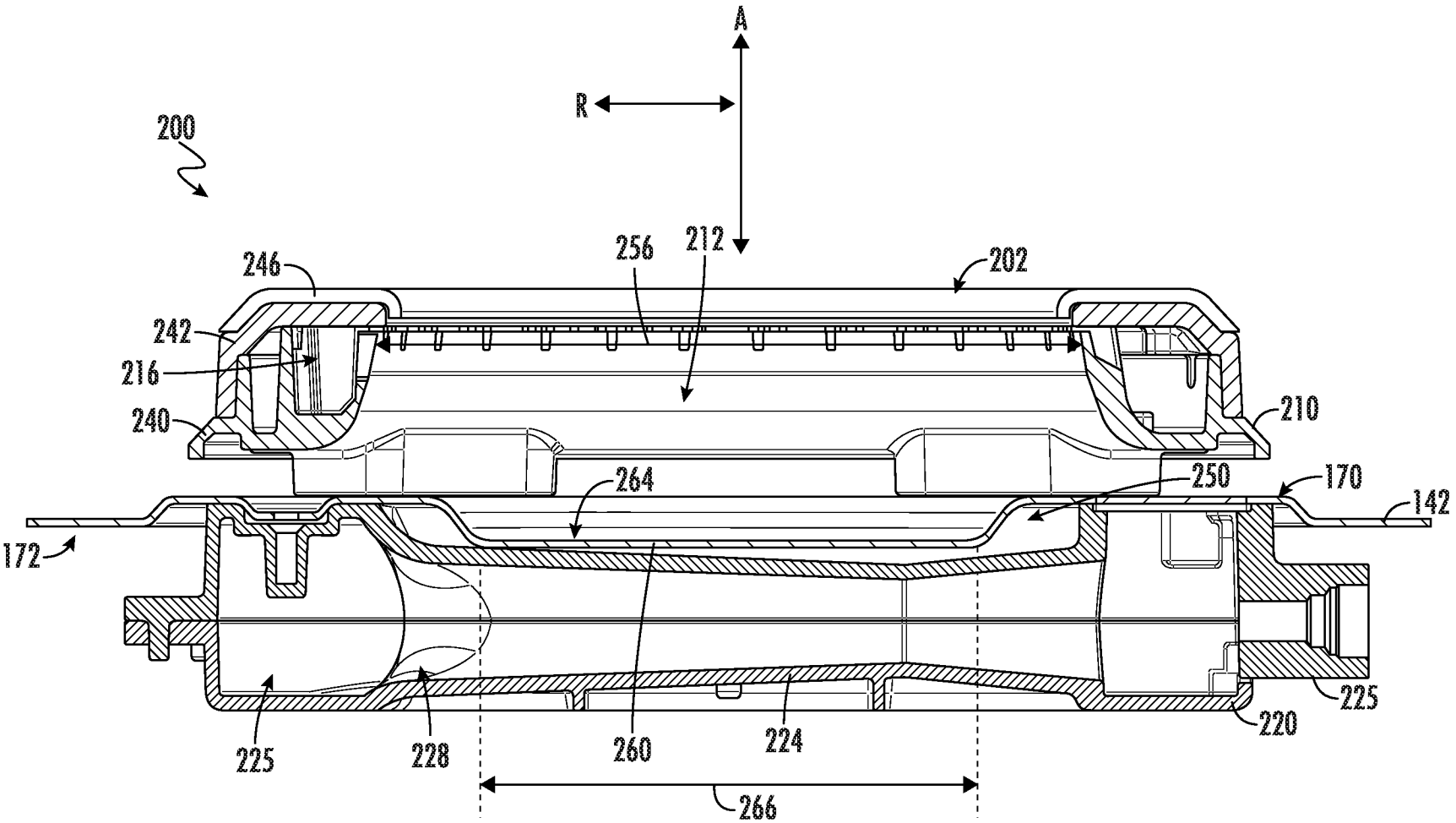
FIG. 20 provides an elevational cross-section view of the exemplary gas burner assembly embodiment of FIG. 17.

As shown in FIGS. 4 through 8, top panel 142 may be formed as a flat or planar panel (e.g., at the central combustion zone 212). Nonetheless, turning briefly to FIG. 9, optional embodiments of thermal break 250 further include a negative embossing 260 at the circumferentially bounded portion of top panel 142. In particular, negative embossing 260 may extend downward (e.g., along the vertical or axial direction A). For instance, negative embossing 260 may extend away from annular burner body 210 or toward top face 254 to a predefined depth 262 (e.g., defined at a lowermost upward-facing surface of top panel 142). In some embodiments, the predefined depth 262 is greater than or equal to 0.1 inches, 0.2 inches, or 0.5 inches.

In some embodiments, negative embossing 260 is horizontally sized to match the size of top face 254. Thus, the bottom embossing face 264 may span at least a portion of the horizontal area defined by the top face 254 (e.g., in the radial plane). As shown, the horizontal area of the bottom embossing face 264 may be axially aligned with the horizontal area of the top face 254 (e.g., such that the horizontal areas are coaxial with each other). Optionally, the bottom embossing face 264 may define an embossing radius or width 266 that is greater than or equal to horizontal face width 258. Additionally or alternatively, the embossing width 266 at the bottom embossing face 264 may be at least 50% of the maximum width defined at the top of embossing (e.g., point of descent from the upper edge of top panel 142, such as that which defines the upper end of predefined depth 262).

Turning now to FIGS. 3 and 10 through 15, various portions of a gas burner assembly 200 according to another exemplary embodiment of the present disclosure. As an example, burner assembly 200 may be used in range appliance 100 (FIG. 2) as one of burner assemblies 144, 146, 148, 150. Nonetheless, it will be understood that, while describe in greater detail below in the context of range appliance 100, burner assembly 200 may be used in or with any suitable appliance in alternative exemplary embodiments. Except as otherwise provided below, it is understood that the embodiments of FIGS. 10 through 15 include the same features as the above-described embodiments.

As shown, thermal break 250 may include a conductive heat sink 252 formed from a thermally conductive metal material (e.g., aluminum or steel, including alloys thereof) below top panel 142. In some embodiments, conductive heat sink 252 extends (e.g., upward along the vertical or axial direction A) from fuel manifold 220 to a top face 254. Thus, the base or bottom of conductive heat sink 252 may be disposed on or formed at fuel manifold 220 while top face 254 defines the upper end of conductive heat sink 252. For instance, the base or bottom of conductive heat sink 252 may be formed on horizontal Venturi mixing tube 224. Optionally, conductive heat sink 252 may be formed as an integral unitary (e.g., monolithic) element with at least a portion of fuel manifold 220.

In certain embodiments, a deformable contact plate 268 is provided between at least a portion of top face 254 and bottom surface 172. For instance, a deformable contact plate 268 may rest on top face 254. Optionally, a circumferential groove 270 defined in top surface 170 may receive a radial edge of deformable contact plate 268. When assembled, deformable contact plate 268 may be sandwiched between top face 254 and bottom surface 172 (i.e., in contact or conductive thermal communication with both top face 254 and bottom surface 172). Thus, during use (e.g., cooking or burning operations of burner assembly 200), heat received at top panel 142 may be conducted from top panel 142 through deformable contact plate 268 to conductive heat sink 252, and from conductive heat sink 252 to fuel manifold 220 and the ambient air surrounding conductive heat sink 252.

Generally, deformable contact plate 268 is configured to deform when sandwiched between top face 254 and bottom surface 172. In some embodiments, deformable contact plate 268 defines one or more bends (e.g., vertical bends). The bends may form a wavy appearance and predefined points at which deformable contact plate 268 may resiliently deform or flatten, thereby maintaining contact with both top face 254 and bottom surface 172. Additionally or alternatively, one or more radial grooves may be defined within deformable contact plate 268 to separate two or more solid segments (e.g., blades) of deformable contact plate 268 and permit circumferential deformation of the same segments. Further additional or alternative embodiments of deformable contact plate 268 may include or be formed as a metal mesh, expanded metal lattice, or other suitable deformable thermal conductor.

As shown, deformable contact plate 268 may be disposed beneath the bottom surface 172 at the circumferentially bounded portion of top panel 142. Thus, deformable contact plate 268 spans at least a portion of the horizontal area defined by the central combustion zone 212 (e.g., in the radial plane). In certain embodiments, deformable contact plate 268 may define a horizontal area having a horizontal plate radius or width 272 (e.g., maximum width along the radial direction R or parallel to the horizontal zone width 256). As shown, the horizontal area of the deformable contact plate 268 may overlap the horizontal area of the central combustion zone 212 (e.g., in the radial plane viewed from above or below assembly 200). For instance, the horizontal area of the deformable contact plate 268 may be axially aligned with the horizontal area of the central combustion zone 212 (e.g., such that the horizontal areas are coaxial with each other). In some such embodiments, the horizontal plate width 272 may be greater than (e.g., define a measured distance) 40% of the horizontal zone width 256; such as greater than or equal to 50%, 75%, or 95%. In additional or alternative embodiments, the horizontal plate width 272 may be less than or equal to the horizontal zone width 256.

Turning now to FIGS. 16 through 22, various portions of a gas burner assembly 200 according to other exemplary embodiments of the present disclosure. As an example, burner assembly 200 may be used in range appliance 100 (FIG. 2) as one of burner assemblies 144, 146, 148, 150. Nonetheless, it will be understood that, while describe in greater detail below in the context of range appliance 100, burner assembly 200 may be used in or with any suitable appliance in alternative exemplary embodiments. Except as otherwise provided below, it is understood that the embodiments of FIGS. 16 through 22 include the same features as the above-described embodiments.

As shown, thermal break 250 may include a negative embossing 260 (e.g., independent of a separate heat sink). In some embodiments, negative embossing 260 extends downward (e.g., along the vertical or axial direction A). For instance, negative embossing 260 may extend away from annular burner body 210 or toward a portion of fuel manifold 220, such as horizontal Venturi mixing tube 224. For instance, negative embossing 260 may extend away from annular burner body 210 or toward top face 254 to a predefined depth 262 (e.g., defined at a lowermost upward-facing surface of top panel 142). In some embodiments, the predefined depth 262 is greater than or equal to 0.1 inches, 0.2 inches, or 0.5 inches.

In some embodiments, negative embossing 260 spans at least a portion of the horizontal area defined by the central combustion zone 212 (e.g., in the radial plane). In certain embodiments, negative embossing 260 may define a horizontal area having a horizontal embossing radius or width 266 (e.g., maximum width along the radial direction R or parallel to the horizontal zone width 256). As shown, the horizontal area of the negative embossing 260 may overlap the horizontal area of the central combustion zone 212 (e.g., in the radial plane viewed from above or below assembly 200). For instance, the horizontal area of the negative embossing 260 may be axially aligned with the horizontal area of the central combustion zone 212 (e.g., such that the horizontal areas are coaxial with each other). In some such embodiments, the horizontal embossing width 266 may be greater than (e.g., define a measured distance) 40% of the horizontal zone width 256; such as greater than or equal to 50%, 75%, or 95%. In additional or alternative embodiments, the horizontal embossing width 266 may be less than or equal to the horizontal zone width 256.

Figure 21:
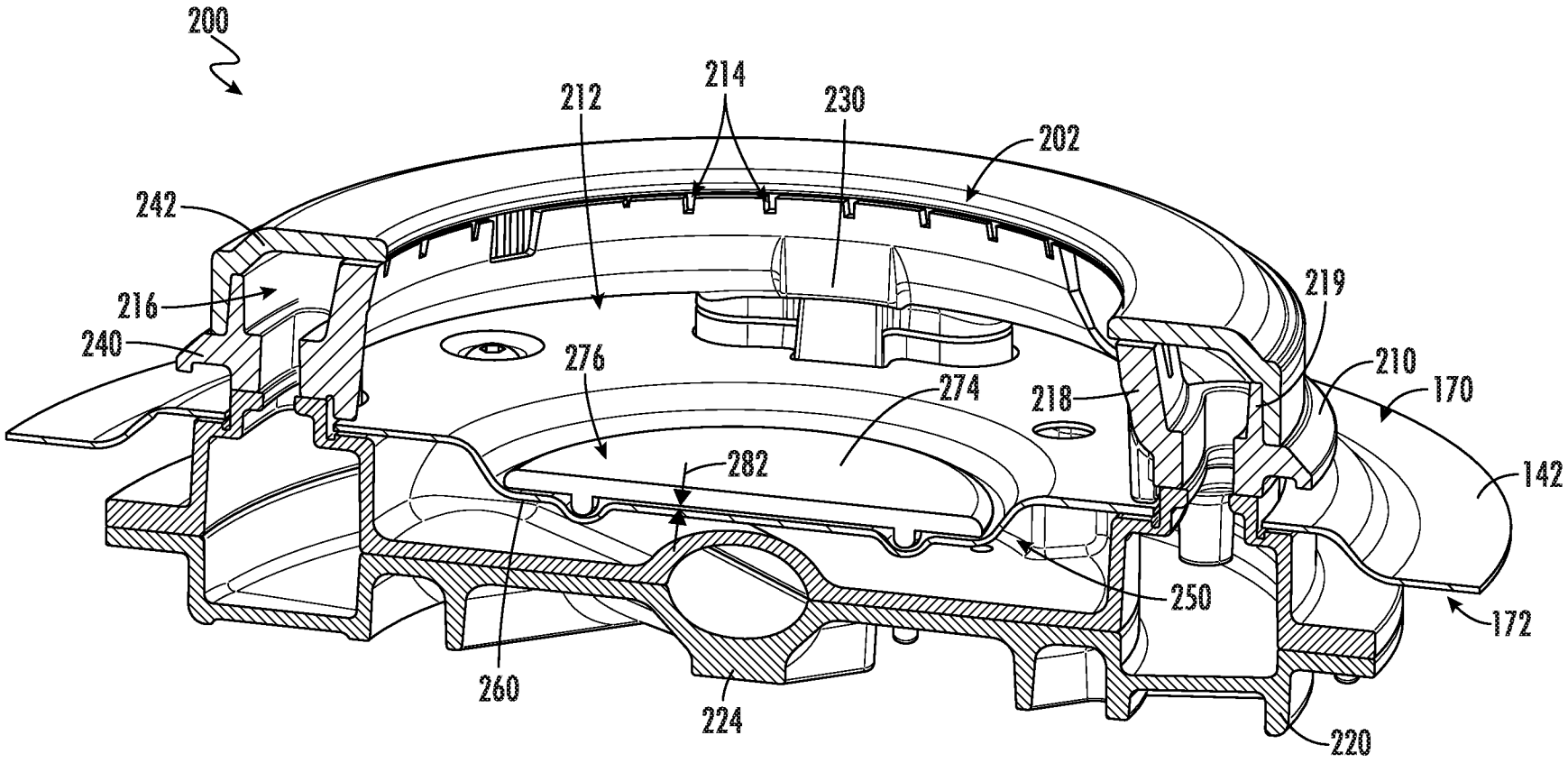
FIG. 21 provides a perspective cross-section view of an exemplary gas burner assembly embodiment of FIG. 16.
Figure 22:
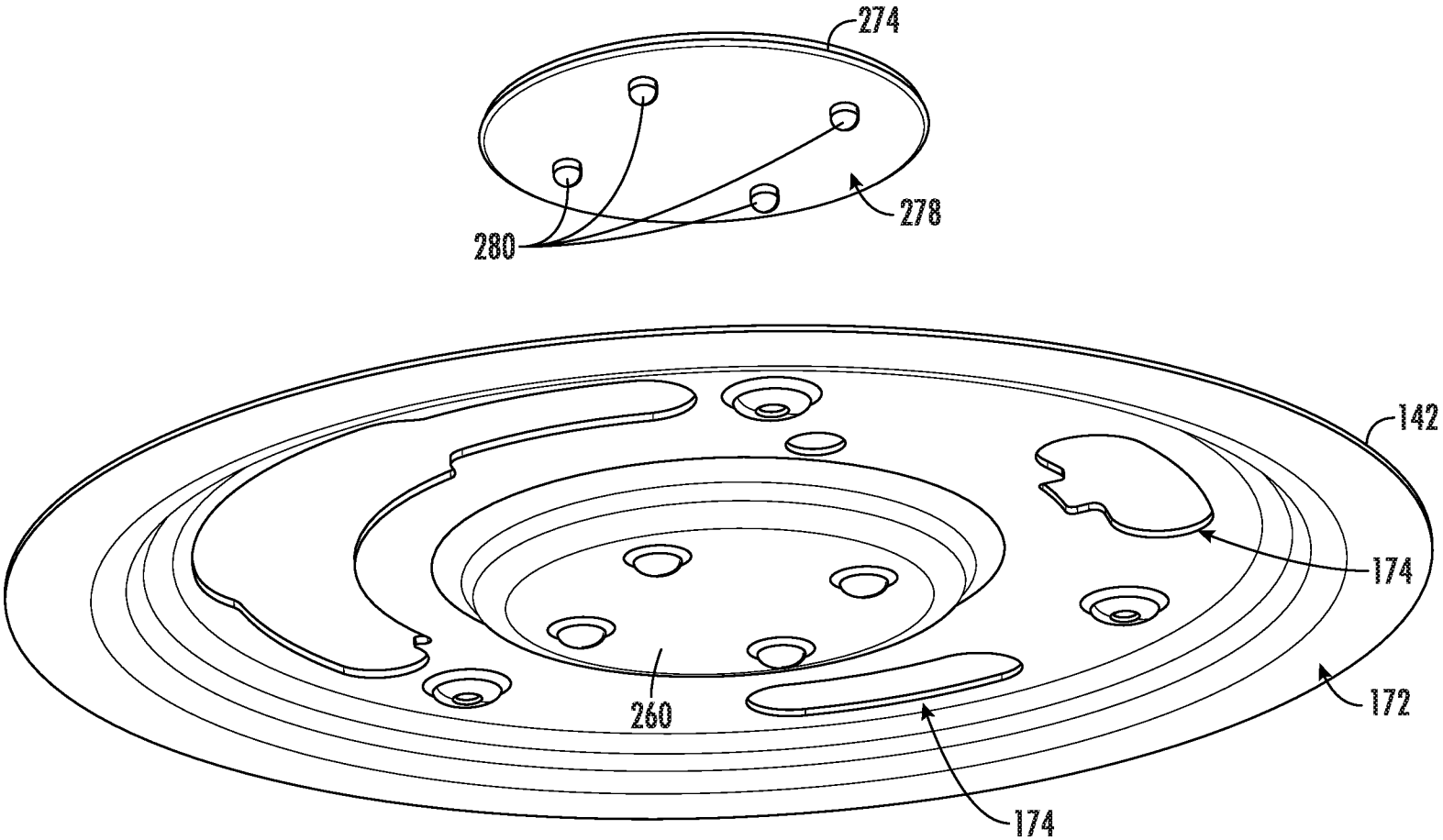
FIG. 22 provides a bottom, exploded, perspective of the top panel and insert of the exemplary gas burner assembly embodiment of FIG. 21.

As shown especially in FIGS. 21 and 22, optional embodiments of thermal heat sink further include an insert disk 274 received (e.g., selectively received or resting within) negative embossing 260. For instance, an insert disk 274 formed of a heat resistant material (e.g., steel or ceramic, such as a porcelain-coated steel disk) may be selectively placed within negative embossing 260 to further restrict or manage heat transfer to top panel 142. Generally, insert disk 274 may be shaped to complement negative embossing 260. In some such embodiments, the vertical or axial thickness of insert disk 274 may be less than or equal to the predefined depth 262 of negative embossing 260.

Insert disk 274 defines an upper face 276 and an opposite lower face 278. When assembled, upper face 276 is directed upward toward the central combustion zone 212 while lower face 278 is directed downward toward the bottom face 264 of negative embossing 260. In certain embodiments, a one or more disk feet 280 extend from or otherwise vertically support insert disk 274 within negative embossing 260. A vertical gap 282 may further be defined between the lower face 278 of insert disk 274 and the top surface 170 of top panel 142 at the negative embossing 260.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance, comprising:

a top panel; and a gas burner assembly positioned at the top panel, the gas burner assembly comprising an annular burner body positioned on the top panel at a top surface of the top panel, the annular burner body defining a central combustion zone, a plurality of flame ports at the central combustion zone, and a fuel chamber upstream from the plurality of flame ports to permit gaseous fuel flow into the central combustion zone through the plurality of flame ports, the annular burner body being open at the central combustion zone such that a circumferentially bounded portion of the top panel is vertically exposed through the annular burner body at the central combustion zone, a fuel manifold selectively connected to the annular burner body upstream from the fuel chamber such that the gaseous fuel is flowable from the fuel manifold into the fuel chamber, and a thermal break formed along the circumferentially bounded portion of the top panel below the plurality of flame port, wherein the thermal break comprises a negative embossing defined by the circumferentially bounded portion of the top panel and extending downward away from the annular burner body.

2. The cooktop appliance of claim 1, wherein the thermal break further comprises an insert disk received within the negative embossing.

3. The cooktop appliance of claim 2, wherein the insert disk defines an upper face directed upward toward the central combustion zone and a lower face directed downward toward the negative embossing, and wherein a vertical gap is defined between the lower face of the insert disk and the top surface of the top panel at the negative embossing.

4. The cooktop appliance of claim 1, wherein the central combustion zone has a horizontal zone width, wherein the negative embossing has a horizontal embossing width that is greater than 40% of the horizontal zone width.

5. The cooktop appliance of claim 1, wherein no portion of the annular burner body is positioned within the central combustion zone above the top panel.

6. A cooktop appliance, comprising:

a top panel; and a gas burner assembly positioned at the top panel, the gas burner assembly comprising an annular burner body positioned on the top panel at a top surface of the top panel, the annular burner body defining a central combustion zone, a plurality of flame ports at the central combustion zone, and a fuel chamber upstream from the plurality of flame ports to permit gaseous fuel flow into the central combustion zone through the plurality of flame ports, the annular burner body being open at the central combustion zone such that a circumferentially bounded portion of the top panel is vertically exposed through the annular burner body at the central combustion zone, a fuel manifold selectively connected to the annular burner body upstream from the fuel chamber such that the gaseous fuel is flowable from the fuel manifold into the fuel chamber, the fuel manifold comprising a horizontal Venturi mixing tube disposed beneath the circumferentially bounded portion of the top panel, and a thermal break formed along the circumferentially bounded portion of the top panel below the annular burner body and above the horizontal Venturi mixing tube, wherein the thermal break comprises a negative embossing defined by the circumferentially bounded portion of the top panel and extending downward away from the annular burner body.

7. The cooktop appliance of claim 6, wherein the thermal break further comprises an insert disk received within the negative embossing.

8. The cooktop appliance of claim 7, wherein the insert disk defines an upper face directed upward toward the central combustion zone and a lower face directed downward toward the negative embossing, and wherein a vertical gap is defined between the lower face of the insert disk and the top surface of the top panel at the negative embossing.

9. The cooktop appliance of claim 6, wherein the central combustion zone has a horizontal zone width, wherein the negative embossing has a horizontal embossing width that is greater than 40% of the horizontal zone width.

10. The cooktop appliance of claim 6, wherein no portion of the annular burner body is positioned within the central combustion zone above the top panel.

11. A cooktop appliance, comprising:

a top panel; and a gas burner assembly positioned at the top panel, the gas burner assembly comprising an annular burner body positioned on the top panel at a top surface of the top panel, the annular burner body defining a central combustion zone, a plurality of flame ports at the central combustion zone, and a fuel chamber upstream from the plurality of flame ports to permit gaseous fuel flow into the central combustion zone through the plurality of flame ports, the annular burner body being open at the central combustion zone such that a circumferentially bounded portion of the top panel is vertically exposed through the annular burner body at the central combustion zone, a fuel manifold selectively connected to the annular burner body upstream from the fuel chamber such that the gaseous fuel is flowable from the fuel manifold into the fuel chamber, and a thermal break formed along the circumferentially bounded portion of the top panel below the plurality of flame ports, wherein the thermal break comprises a conductive heat sink extending from the fuel manifold to a top face disposed beneath a bottom surface of the top panel at the circumferentially bounded portion of the top panel such that the conductive heat sink is in conductive thermal communication with the bottom surface of the top panel.

12. The cooktop appliance of claim 11, wherein the central combustion zone has a horizontal zone width, wherein the top face of the conductive heat sink has a horizontal face width that is greater than 40% of the horizontal zone width.

13. The cooktop appliance of claim 11, wherein the thermal break further comprises a deformable contact plate sandwiched between top face of the conductive heat sink and the bottom surface of the top panel at the circumferentially bounded portion of the top panel to conduct heat from the top panel to the conductive heat sink.

14. The cooktop appliance of claim 11, wherein no portion of the annular burner body is positioned within the central combustion zone above the top panel.

15. The cooktop appliance of claim 13, wherein the central combustion zone has a horizontal zone width, wherein the deformable contact plate has a horizontal plate width that is greater than 40% of the horizontal zone width.

16. The cooktop appliance of claim 13, wherein the central combustion zone has a horizontal zone width, wherein the deformable contact plate has a horizontal plate width that is less than or equal to the horizontal zone width.

17. The cooktop appliance of claim 2, wherein the negative embossing has a predefined depth along a vertical direction, and wherein the insert disk has a vertical thickness that is less than or equal to the predefined depth of the negative embossing.

18. The cooktop appliance of claim 7, wherein the negative embossing has a predefined depth along a vertical direction, and wherein the insert disk has a vertical thickness that is less than or equal to the predefined depth of the negative embossing.

19. The cooktop appliance of claim 1, wherein the central combustion zone has a horizontal zone width, wherein the negative embossing has a horizontal embossing width that is less than or equal to the horizontal zone width.

20. The cooktop appliance of claim 6, wherein the central combustion zone has a horizontal zone width, wherein the negative embossing has a horizontal embossing width that is less than or equal to the horizontal zone width.

* * * * *